US010741059B2

(12) United States Patent
Moore et al.

(10) Patent No.: US 10,741,059 B2
(45) **Date of Patent: *Aug. 11, 2020**

(54) SYSTEMS AND METHODS FOR HANDLING LATENT ANOMALIES

(71) Applicant: GOOGLE LLC, Mountain View, CA (US)

(72) Inventors: Tyler Moore, San Francisco, CA (US); Kelly Veit, Mountain View, CA (US); Joseph Jaoudi, Mountain View, CA (US); Geo Hsu, Mountain View, CA (US); David Wang, Mountain View, CA (US); David Liem, Mountain View, CA (US); Terry Simons, San Jose, CA (US); Michael Kwiatkowski, Marietta, GA (US)

(73) Assignee: Google LLC, Mountain View, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/351,965

(22) Filed: Mar. 13, 2019

(65) Prior Publication Data

US 2019/0213866 A1 Jul. 11, 2019

Related U.S. Application Data

(63) Continuation of application No. 15/665,958, filed on Aug. 1, 2017, now Pat. No. 10,242,558, which is a continuation of application No. 15/085,059, filed on Mar. 30, 2016, now Pat. No. 9,922,541.

(60) Provisional application No. 62/256,117, filed on Nov. 16, 2015.

(51) Int. Cl.

| | |
|---|---|
| ***G08B 29/02*** | (2006.01) |
| ***G08B 29/14*** | (2006.01) |
| ***G08B 25/00*** | (2006.01) |
| *G08B 19/00* | (2006.01) |

(52) U.S. Cl.

CPC ..... *G08B 29/02* (2013.01); *G08B 25/002* (2013.01); *G08B 29/14* (2013.01); *G08B 19/005* (2013.01)

(58) Field of Classification Search

CPC .... G08B 19/005; G08B 25/002; G08B 29/02; G08B 29/14

See application file for complete search history.

(56) References Cited

U.S. PATENT DOCUMENTS

| | | | | |
|---|---|---|---|---|
| 7,788,723 | B2 | 8/2010 | Huddleston | |
| 9,396,637 | B2 * | 7/2016 | Chandler | G08B 17/12 |
| 9,922,541 | B2 | 3/2018 | Moore et al. | |
| 10,242,558 | B2 | 3/2019 | Moore et al. | |
| 2006/0192680 | A1 * | 8/2006 | Scuka | G08B 26/002 340/632 |
| 2014/0015680 | A1 * | 1/2014 | Chandler | G08B 17/12 340/630 |
| 2015/0022367 | A1 | 1/2015 | Matsuoka et al. | |

* cited by examiner

*Primary Examiner* — Sisay Yacob
(74) *Attorney, Agent, or Firm* — Kilpatrick Townsend & Stockton LLP

(57) ABSTRACT

Systems and methods for handling latent anomalies in field devices are described herein. When an anomaly is detected, the system can earmark the presence of the detected anomaly with a flag or other notification, and announce the existence of the anomaly to a user. In some embodiments, a self-test may be distributed to devices in the field that may be potentially affected by the latent anomaly so that those devices can monitor for the presence of the anomaly and take appropriate action if detected.

18 Claims, 12 Drawing Sheets

SYSTEMS AND METHODS FOR HANDLING LATENT ANOMALIES

CROSS-REFERENCE TO A RELATED APPLICATION

This application is a continuation of U.S. patent application Ser. No. 15/665,958, filed Aug. 1, 2017 (now U.S. Pat. No. 10, 242,558), which is a continuation-in-part of U.S. patent application Ser. No. 15/085,059, filed Mar. 30, 2016 (now U.S. Pat. No. 9,922,541), which claims the benefit of U.S. Provisional Patent Application No. 62/256,117, filed Nov. 16, 2015, the disclosures of which are incorporated by reference in their entireties.

TECHNICAL FIELD

This patent specification relates to systems and methods for handling latent anomalies in field devices.

BACKGROUND

Electronic devices are typically subjected to a battery of tests during development and production in an attempt to limit or eliminate anomalies (e.g., defects) that affect the operation of the device after its point of sale. However, despite the testing, there may be instances which latent anomalies occur after the point of sale. Accordingly, systems and methods for handling these latent anomalies are needed.

SUMMARY

Systems and methods for handling latent anomalies in field devices are described herein. When an anomaly is detected, the system can earmark the presence of the detected anomaly with a flag or other notification, and announce the existence of the anomaly to a user. In some embodiments, a self-test may be distributed to devices in the field that may be potentially affected by the latent anomaly so that those devices can monitor for the presence of the anomaly and take appropriate action if detected.

In one embodiment, a method for handling latent anomalies is provided. The method can include evaluating a plurality of data sources to detect existence of a latent anomaly, and in response to detecting existence of the latent anomaly: identifying a subset of a plurality of field devices that has potential to exhibit the latent anomaly; and providing a self-test to each field device in the identified subset such that each field device in the identified subset can monitor for the latent anomaly and perform an action in response to monitoring the occurrence of the latent anomaly.

In another embodiment, a field device for handling a latent anomaly is provided that can include a plurality of sensors, communications circuitry, non-volatile memory, and a processor. The process can be operative to receive a self-test module via the communications circuitry, wherein the self-test module comprises instructions that enables the field device to monitor for existence of a latent anomaly, store the received self-test module in the non-volatile memory, and periodically perform a self-test in accordance with the instructions to determine whether the latent anomaly exists within the field device.

In yet another embodiment, a system for handling latent anomalies is provided that can include a plurality of data sources that indicate potential existence of a latent anomaly in at least one of a plurality of field devices, wherein a first one of the plurality of data sources comprises a test system capable of running a battery of tests that subject a test device to stresses that the field device could potentially incur over its operational life, and latent anomaly handing system that receives data from the plurality of data sources. the latent anomaly handling system can be operative to evaluate the data to detect existence of a latent anomaly, and in response to detecting existence of the latent anomaly: identify a subset of a plurality of field devices that has potential to exhibit the latent anomaly, provide a self-test to each field device in the identified subset such that each field device in the identified subset can monitor for the latent anomaly and perform an action in response to monitoring the occurrence of the latent anomaly.

A further understanding of the nature and advantages of the embodiments discussed herein may be realized by reference to the remaining portions of the specification and the drawings.

DETAILED DESCRIPTION OF THE DISCLOSURE

Figure 1:
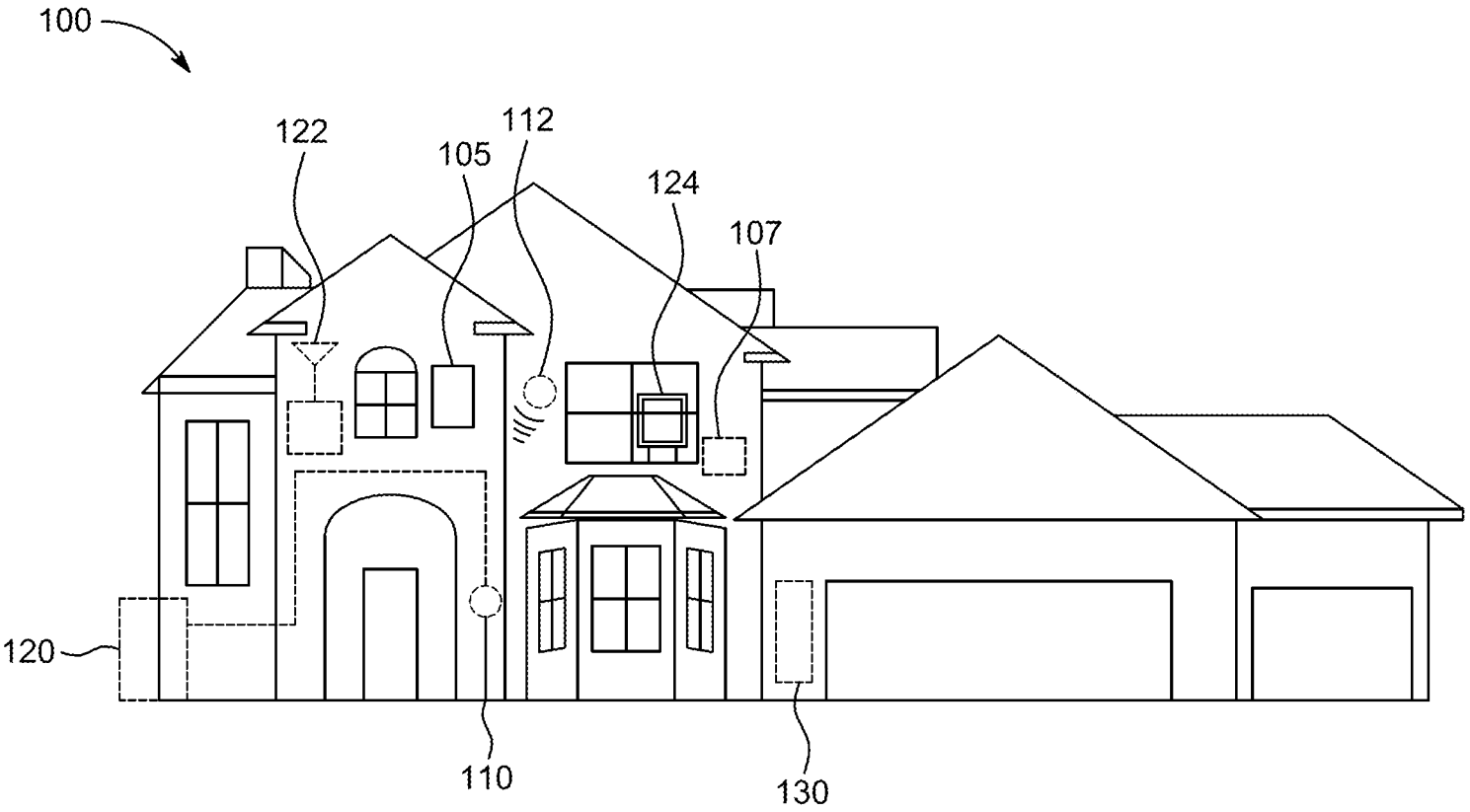
FIG. 1 is a diagram of an enclosure with a hazard detection system, according to some embodiments.

In the following detailed description, for purposes of explanation, numerous specific details are set forth to provide a thorough understanding of the various embodiments. Those of ordinary skill in the art will realize that these various embodiments are illustrative only and are not intended to be limiting in any way. Other embodiments will readily suggest themselves to such skilled persons having the benefit of this disclosure.

In addition, for clarity purposes, not all of the routine features of the embodiments described herein are shown or described. One of ordinary skill in the art would readily appreciate that in the development of any such actual embodiment, numerous embodiment-specific decisions may be required to achieve specific design objectives. These design objectives will vary from one embodiment to another and from one developer to another. Moreover, it will be appreciated that such a development effort might be complex and time-consuming but would nevertheless be a routine engineering undertaking for those of ordinary skill in the art having the benefit of this disclosure.

It is to be appreciated that while one or more devices are described further herein in the context of being used in a residential home, such as a single-family residential home, the scope of the present teachings is not so limited. More generally, the devices are applicable to a wide variety of enclosures such as, for example, duplexes, townhomes, multi-unit apartment buildings, hotels, retail stores, office buildings, and industrial buildings. Further, it is understood that while the terms user, customer, installer, homeowner, occupant, guest, tenant, landlord, repair person, and the like may be used to refer to the person or persons who are interacting with the hazard detector in the context of one or more scenarios described herein, these references are by no means to be considered as limiting the scope of the present teachings with respect to the person or persons who are performing such actions. The embodiments discussed herein may be implemented in any suitable smart home device such as, for example, a thermostat, hazard detection system, a camera system, or a security system. It should be further understood that some embodiments discussed herein may be executed on any device that is not necessarily tied to an enclosure. For example, devices such as personal electronics (e.g., smart phones, laptops, tablets, desktops, music players), automobiles, and household electronics (e.g., washing machine, dryer, dishwashing machine) may all experience latent anomalies that require handling.

As defined herein, a latent anomaly refers to a defect that exists or is discovered to exist within a device after that device has been sold or shipped to the end user. Such devices may be referred to herein as field devices. The defect may exist in hardware or software or both hardware and software. The defect may be an anomaly because its occurrence is rare and hard for a user or existing self-test mechanisms to detect, but has the potential to affect certain operations of the device. Or, perhaps, the anomaly does not exist with a state of embedded software included with the device at the time of shipment, but exists after a software update to that device post-sale. Embodiments discussed herein provide different mechanisms for identifying and responsibly managing latent defects in field devices. It should be appreciated that while the present disclosure is provided predominantly in the context of a smart home environment where field devices are electronic devices therein, one skilled in the art would recognize that the disclosure is not so limited. That is, the techniques, methods, and technologies described herein can equally be applied to a wide variety of electronic devices in and outside of a smart home environment, including but not limited to vehicles such as cars, trucks, motorcycles, etc., appliances such as refrigerators, televisions, vacuum cleaners, dishwashers, clothes washing and drying machines, laundry irons, water softeners, water filtration systems, watering systems, etc., consumer/commercial electronics such as personal computers, laptops, tablets, mobile phones, key fobs, etc., industrial systems such as waste water monitoring/treatment, steel manufacturing, vehicle manufacturing technologies, etc., and communication systems such as cellular/internet antennas and equipment, etc.

FIG. 1 is a diagram illustrating an exemplary enclosure 100 using hazard detection system 105, remote hazard detection system 107, thermostat 110, remote thermostat 112, heating, cooling, and ventilation (HVAC) system 120, router 122, computer 124, and central panel 130 in accordance with some embodiments. Enclosure 100 can be, for example, a single-family dwelling, a duplex, an apartment within an apartment building, a warehouse, or a commercial structure such as an office or retail store. Hazard detection system 105 can be battery powered, line powered, or line powered with a battery backup. Hazard detection system 105 can include one or more processors, multiple sensors, non-volatile storage, and other circuitry to provide desired safety monitoring and user interface features. Some user interface features may only be available in line powered embodiments due to physical limitations and power constraints. In addition, some features common to both line and battery powered embodiments may be implemented differently. Hazard detection system 105 can include the following components: low power wireless personal area network (6LoWPAN) circuitry, a system processor, a safety processor, non-volatile memory (e.g., Flash), WiFi circuitry, an ambient light sensor (ALS), a smoke sensor, a carbon monoxide (CO) sensor, a temperature sensor, a humidity sensor, a noise sensor, one or more ultrasonic sensors, a passive infra-red (PIR) sensor, a speaker, one or more light emitting diodes (LED's), and an alarm buzzer.

Hazard detection system 105 can monitor environmental conditions associated with enclosure 100 and alarm occupants when an environmental condition exceeds a predetermined threshold. The monitored conditions can include, for example, smoke, heat, humidity, carbon monoxide, carbon dioxide, radon, and other gasses. In addition to monitoring the safety of the environment, hazard detection system 105 can provide several user interface features not found in conventional alarm systems. These user interface features can include, for example, vocal alarms, voice setup instructions, cloud communications (e.g. push monitored data to the cloud, or push notifications to a mobile telephone, or receive software updates from the cloud), device-to-device communications (e.g., communicate with other hazard detection systems in the enclosure, including the communication of software updates between hazard detection systems), visual safety indicators (e.g., display of a green light indicates it is safe and display of a red light indicates danger), tactile and non-tactile input command processing, and software updates.

Hazard detection system 105 can implement multi-criteria state machines according to various embodiments described herein to provide advanced hazard detection and advanced user interface features such as pre-alarms. In addition, the multi-criteria state machines can manage alarming states and pre-alarming states and can include one or more sensor state machines that can control the alarming states and one or more system state machines that control the pre-alarming states. Each state machine can transition among any one of its states based on sensor data values, hush events, and transition conditions. The transition conditions can define how a state machine transitions from one state to another, and ultimately, how hazard detection system 105 operates. Hazard detection system 105 can use a dual processor arrangement to execute the multi-criteria state machines according to various embodiments. The dual processor arrangement may enable hazard detection system 105 to manage the alarming and pre-alarming states in a manner that uses minimal power while simultaneously providing relatively failsafe hazard detection and alarming functionalities. Additional details of the various embodiments of hazard detection system 105 are discussed below.

Enclosure 100 can include any number of hazard detection systems. For example, as shown, hazard detection system 107 is another hazard detection system, which may be similar to system 105. In one embodiment, both systems 105 and 107 can be battery powered systems. In another embodiment, system 105 may be line powered, and system 107 may be battery powered. Moreover, a hazard detection system can be installed outside of enclosure 100.

Thermostat 110 can be one of several thermostats that may control HVAC system 120. Thermostat 110 can be referred to as the "primary" thermostat because it may be electrically connected to actuate all or part of an HVAC system, by virtue of an electrical connection to HVAC control wires (e.g. W, G, Y, etc.) leading to HVAC system 120. Thermostat 110 can include one or more sensors to gather data from the environment associated with enclosure 100. For example, a sensor may be used to detect occupancy, temperature, light and other environmental conditions within enclosure 100. Remote thermostat 112 can be referred to as an "auxiliary" thermostat because it may not be electrically connected to actuate HVAC system 120, but it too may include one or more sensors to gather data from the environment associated with enclosure 100 and can transmit data to thermostat 110 via a wired or wireless link. For example, thermostat 112 can wirelessly communicate with and cooperates with thermostat 110 for improved control of HVAC system 120. Thermostat 112 can provide additional temperature data indicative of its location within enclosure 100, provide additional occupancy information, or provide another user interface for the user (e.g., to adjust a temperature setpoint).

Hazard detection systems 105 and 107 can communicate with thermostat 110 or thermostat 112 via a wired or wireless link. For example, hazard detection system 105 can wirelessly transmit its monitored data (e.g., temperature and occupancy detection data) to thermostat 110 so that it is provided with additional data to make better informed decisions in controlling HVAC system 120. Moreover, in some embodiments, data may be transmitted from one or more of thermostats 110 and 112 to one or more of hazard detections systems 105 and 107 via a wired or wireless link.

Central panel 130 can be part of a security system or other master control system of enclosure 100. For example, central panel 130 may be a security system that may monitor windows and doors for break-ins, and monitor data provided by motion sensors. In some embodiments, central panel 130 can also communicate with one or more of thermostats 110 and 112 and hazard detection systems 105 and 107. Central panel 130 may perform these communications via wired link, wireless link, or a combination thereof. For example, if smoke is detected by hazard detection system 105, central panel 130 can be alerted to the presence of smoke and make the appropriate notification, such as displaying an indicator that a particular zone within enclosure 100 is experiencing a hazard condition.

Enclosure 100 may further include a private network accessible both wirelessly and through wired connections and may also be referred to as a Local Area Network or LAN. Network devices on the private network can include hazard detection systems 105 and 107, thermostats 110 and 112, computer 124, and central panel 130. In one embodiment, the private network is implemented using router 122, which can provide routing, wireless access point functionality, firewall and multiple wired connection ports for connecting to various wired network devices, such as computer 124. Wireless communications between router 122 and networked devices can be performed using an 802.11 protocol. Router 122 can further provide network devices access to a public network, such as the Internet or the Cloud, through a cable-modem, DSL modem and an Internet service provider or provider of other public network services. Public networks like the Internet are sometimes referred to as a Wide-Area Network or WAN.

Access to the Internet, for example, may enable networked devices such as system 105 or thermostat 110 to communicate with a device or server remote to enclosure 100. The remote server or remote device can host an account management program that manages various networked devices contained within enclosure 100. For example, in the context of hazard detection systems according to embodiments discussed herein, system 105 can periodically upload data to the remote server via router 122. In addition, if a hazard event is detected, the remote server or remote device can be notified of the event after system 105 communicates the notice via router 122. Similarly, system 105 can receive data (e.g., commands or software updates) from the account management program via router 122.

Hazard detection system 105 can operate in one of several different power consumption modes. Each mode can be characterized by the features performed by system 105 and the configuration of system 105 to consume different amounts of power. Each power consumption mode corresponds to a quantity of power consumed by hazard detection system 105, and the quantity of power consumed can range from a lowest quantity to a highest quantity. One of the power consumption modes corresponds to the lowest quantity of power consumption, and another power consumption mode corresponds to the highest quantity of power consumption, and all other power consumption modes fall somewhere between the lowest and the highest quantities of power consumption. Examples of power consumption modes can include an Idle mode, a Log Update mode, a Software Update mode, an Alarm mode, a Pre-Alarm mode, a Hush mode, and a Night Light mode. These power consumption modes are merely illustrative and are not meant to be limiting. Additional or fewer power consumption modes may exist. Moreover, any definitional characterization of the different modes described herein is not meant to be all inclusive, but rather, is meant to provide a general context of each mode.

Figure 2:
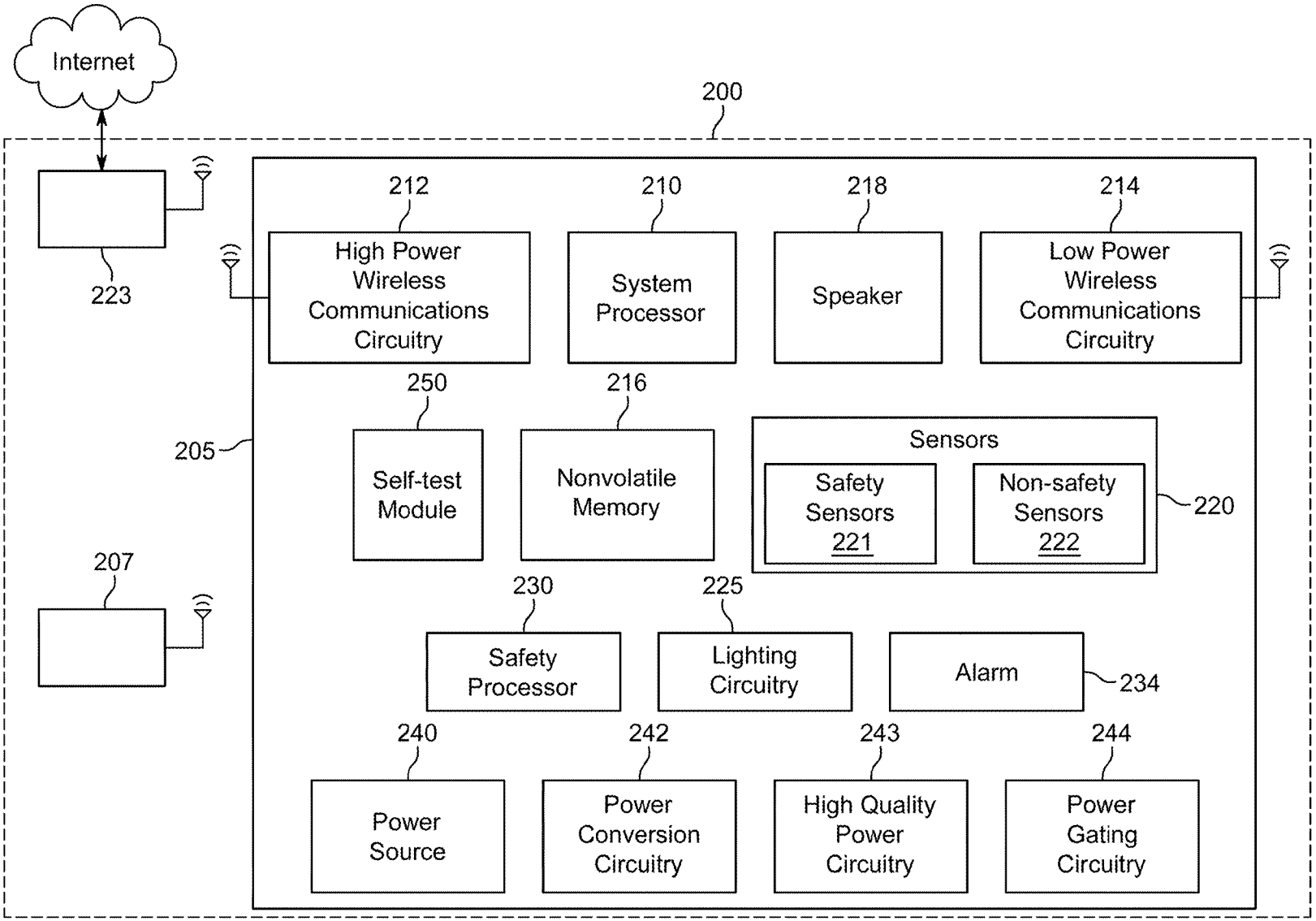
FIG. 2 shows an illustrative block diagram of a hazard detection system being used in an illustrative enclosure, according to some embodiments.

FIG. 2 shows an illustrative block diagram of a field device such as hazard detection system 205 being used in an illustrative enclosure 200 in accordance with some embodiments. FIG. 2 also shows optional hazard detection system 207 and router 223. Hazard detection systems 205 and 207 can be similar to hazard detection systems 105 and 107 in FIG. 1, enclosure 200 can be similar to enclosure 100 in FIG. 1, and router 223 can be similar to router 122 in FIG. 1. Hazard detection system 205 can include several components, including system processor 210, high-power wireless communications circuitry 212 and antenna, low-power wireless communications circuitry 214 and antenna, non-volatile memory 216, speaker 218, sensors 220, which can include one or more safety sensors 221 and one or more non-safety sensors 222, lighting circuitry 225, safety processor 230, alarm 234, power source 240, power conversion circuitry 242, high quality power circuitry 243, power gating circuitry 244, self-test module 250. Hazard detection system 205 may be operative to provide failsafe safety detection features and user interface features using circuit topology and power budgeting methods that may minimize power consumption.

Hazard detection system 205 can use a bifurcated processor circuit topology for handling the features of system 205. Both system processor 210 and safety processor 230 can exist on the same circuit board within system 205, but perform different tasks. System processor 210 is a larger more capable processor that can consume more power than safety processor 230. That is, when both processors 210 and 230 are active, processor 210 consumes more power than processor 230. Similarly, when both processors are inactive, processor 210 may consume more power than processor 230. System processor 210 can be operative to process user interface features. For example, processor 210 can direct wireless data traffic on both high and low power wireless communications circuitries 212 and 214, access non-volatile memory 216, communicate with processor 230, and cause audio to be emitted from speaker 218. As another example, processor 210 can monitor data acquired by one or more sensors 220 to determine whether any actions need to be taken (e.g., shut off a blaring alarm in response to a user detected action to hush the alarm).

Safety processor 230 can be operative to handle safety related tasks of system 205, or other types of tasks that involve monitoring environmental conditions (such as temperature, humidity, smoke, carbon monoxide, movement, light intensity, etc.) exterior to the hazard detection system 205. Safety processor 230 can poll one or more of sensors 220 and activate alarm 234 when one or more of sensors 220 indicate a hazard event is detected. Processor 230 can operate independently of processor 210 and can activate alarm 234 regardless of what state processor 210 is in. For example, if processor 210 is performing an active function (e.g., performing a WiFi update) or is shut down due to power constraints, processor 230 can activate alarm 234 when a hazard event is detected. In some embodiments, the software running on processor 230 may be permanently fixed and may never be updated via a software or firmware update after system 205 leaves the factory. In other embodiments, processor 230 may be updated when system 205 is in the field.

Compared to processor 210, processor 230 is a less power consuming processor. Thus by using processor 230 in lieu of processor 210 to monitor a subset of sensors 220 yields a power savings. If processor 210 were to constantly monitor sensors 220, the power savings may not be realized. In addition to the power savings realized by using processor 230 for monitoring the subset of sensors 220, bifurcating the processors also ensures that the safety monitoring and core monitoring and alarming features of system 205 will operate regardless of whether processor 210 is functioning. By way of example and not by way of limitation, system processor 210 may comprise a relatively high-powered processor such as Freescale Semiconductor K60 Microcontroller, while safety processor 230 may comprise a relatively low-powered processor such as a Freescale Semiconductor KL15 Microcontroller. Overall operation of hazard detection system 205 entails a judiciously architected functional overlay of system processor 210 and safety processor 230, with system processor 210 performing selected higher-level, advanced functions that may not have been conventionally associated with hazard detection units (for example: more advanced user interface and communications functions; various computationally-intensive algorithms to sense patterns in user behavior or patterns in ambient conditions; algorithms for governing, for example, the brightness of an LED night light as a function of ambient brightness levels; algorithms for governing, for example, the sound level of an onboard speaker for home intercom functionality; algorithms for governing, for example, the issuance of voice commands to users; algorithms for uploading logged data to a central server; algorithms for establishing network membership; algorithms for facilitating updates to the programmed functionality of one or more elements of the hazard detection system 205 such as the safety processor 230, the high power wireless communications circuitry 212, the low power wireless communications circuitry 214, the system processor 210 itself, etc., and so forth), and with safety processor 230 performing the more basic functions that may have been more conventionally associated with hazard detection units (e.g., smoke and CO monitoring, actuation of shrieking/buzzer alarms upon alarm detection). By way of example and not by way of limitation, system processor 210 may consume on the order of 18 mW when it is in a relatively high-power active state and performing one or more of its assigned advanced functionalities, whereas safety processor 230 may only consume on the order of 0.05 mW when it is performing its basic monitoring functionalities. However, again by way of example and not by way of limitation, system processor 210 may consume only on the order of 0.005 mW when in a relatively low-power inactive state, and the advanced functions that it performs are judiciously selected and timed such that the system processor is in the relatively high power active state only about 0.05% of the time, and spends the rest of the time in the relatively low-power inactive state. Safety processor 230, while only requiring an average power draw of 0.05 mW when it is performing its basic monitoring functionalities, should of course be performing its basic monitoring functionalities 100% of the time. According to one or more embodiments, the judiciously architected functional overlay of system processor 210 and safety processor 230 is designed such that hazard detection system 205 can perform basic monitoring and shriek/buzzer alarming for hazard conditions even in the event that system processor 210 is inactivated or incapacitated, by virtue of the ongoing operation of safety processor 230. Therefore, while system processor 210 is configured and programmed to provide many different capabilities for making hazard detection unit 205 an appealing, desirable, updatable, easy-to-use, intelligent, network-connected sensing and communications node for enhancing the smart-home environment, its functionalities are advantageously provided in the sense of an overlay or adjunct to the core safety operations governed by safety processor 230, such that even in the event there are operational issues or problems with system processor 210 and its advanced functionalities, the underlying safety-related purpose and functionality of hazard detector 205 by virtue of the operation of safety processor 230 will continue on, with or without system processor 210 and its advanced functionalities.

High power wireless communications circuitry 212 can be, for example, a Wi-Fi module capable of communicating according to any of the 802.11 protocols. For example, circuitry 212 may be implemented using WiFi part number BCM43362, available from Murata. Depending on an operating mode of system 205, circuitry 212 can operate in a low power "sleep" state or a high power "active" state. For example, when system 205 is in an Idle mode, circuitry 212 can be in the "sleep" state. When system 205 is in a non-Idle mode such as a Wi-Fi update mode, software update mode, or alarm mode, circuitry 212 can be in an "active" state. For example, when system 205 is in an active alarm mode, high power circuitry 212 may communicate with router 223 so that a message can be sent to a remote server or device.

Low power wireless communications circuitry 214 can be a low power Wireless Personal Area Network (6LoWPAN)

module or a ZigBee module capable of communicating according to an 802.15.4 protocol. For example, in one embodiment, circuitry 214 can be part number EM357 SoC available from Silicon Laboratories. Depending on the operating mode of system 205, circuitry 214 can operate in a relatively low power "listen" state or a relatively high power "transmit" state. When system 205 is in the Idle mode, WiFi update mode (which may require use of the high power communication circuitry 212), or software update mode, circuitry 214 can be in the "listen" state. When system 205 is in the Alarm mode, circuitry 214 can transmit data so that the low power wireless communications circuitry in system 207 can receive data indicating that system 205 is alarming. Thus, even though it is possible for high power wireless communications circuitry 212 to be used for listening for alarm events, it can be more power efficient to use low power circuitry 214 for this purpose. Power savings may be further realized when several hazard detection systems or other systems having low power circuitry 214 form an interconnected wireless network.

Power savings may also be realized because in order for low power circuitry 214 to continually listen for data transmitted from other low power circuitry, circuitry 214 may constantly be operating in its "listening" state. This state consumes power, and although it may consume more power than high power circuitry 212 operating in its sleep state, the power saved versus having to periodically activate high power circuitry 214 can be substantial. When high power circuitry 212 is in its active state and low power circuitry 214 is in its transmit state, high power circuitry 212 can consume substantially more power than low power circuitry 214.

In some embodiments, low power wireless communications circuitry 214 can be characterized by its relatively low power consumption and its ability to wirelessly communicate according to a first protocol characterized by relatively low data rates, and high power wireless communications circuitry 212 can be characterized by its relatively high power consumption and its ability to wirelessly communicate according to a second protocol characterized by relatively high data rates. The second protocol can have a much more complicated modulation than the first protocol.

In some embodiments, low power wireless communications circuitry 214 may be a mesh network compatible module that does not require an access point or a router in order to communicate to devices in a network. Mesh network compatibility can include provisions that enable mesh network compatible modules to keep track of other nearby mesh network compatible modules so that data can be passed through neighboring modules. Mesh network compatibility is essentially the hallmark of the 802.15.4 protocol. In contrast, high power wireless communications circuitry 212 is not a mesh network compatible module and requires an access point or router in order to communicate to devices in a network. Thus, if a first device having circuitry 212 wants to communicate data to another device having circuitry 212, the first device has to communicate with the router, which then transmits the data to the second device. In some embodiments, circuitry 212 can be used to communicate directly with another device that has circuitry 212.

Non-volatile memory 216 can be any suitable permanent memory storage such as, for example, NAND Flash, a hard disk drive, NOR, ROM, or phase change memory. In one embodiment, non-volatile memory 216 can store audio clips that can be played back by speaker 218. The audio clips can include installation instructions or warnings in one or more languages. Speaker 218 can be any suitable speaker operable to playback sounds or audio files. Speaker 218 can include an amplifier (not shown).

Sensors 220 can be monitored by safety processor 230 (and, in some embodiments, system processor 210), and can include safety sensors 221 and non-safety sensors 222. One or more of sensors 220 may be exclusively monitored by one of system processor 210 and safety processor 230. As defined herein, monitoring a sensor refers to a processor's ability to acquire data from that monitored sensor. That is, one particular processor may be responsible for acquiring sensor data, and possibly storing it in a sensor log, but once the data is acquired, it can be made available to another processor either in the form of logged data or real-time data. For example, in one embodiment, system processor 210 may monitor one of non-safety sensors 222, but safety processor 230 cannot monitor that same non-safety sensor. In another embodiment, safety processor 230 may monitor each of the safety sensors 221, but may provide the acquired sensor data (or some information indicative of the acquired sensor data) to system processor 210.

Safety sensors 221 can include sensors necessary for ensuring that hazard detection system 205 can monitor its environment for hazardous conditions and alert users when hazardous conditions are detected, and all other sensors not necessary for detecting a hazardous condition are non-safety sensors 222. In some embodiments, safety sensors 221 include only those sensors necessary for detecting a hazardous condition. For example, if the hazardous condition includes smoke and fire, then the safety sensors might only include a smoke sensor and at least one heat sensor. Other sensors, such as non-safety sensors, could be included as part of system 205, but might not be needed to detect smoke or fire. As another example, if the hazardous condition includes carbon monoxide, then the safety sensor might be a carbon monoxide sensor, and no other sensor might be needed to perform this task.

Thus, sensors deemed necessary can vary based on the functionality and features of hazard detection system 205. In one embodiment, hazard detection system 205 can be a combination smoke, fire, and carbon monoxide alarm system. In such an embodiment, detection system 205 can include the following safety sensors 221: a smoke detector, a carbon monoxide (CO) sensor, and one or more heat sensors. Smoke detectors can detect smoke and typically use optical detection, ionization, or air sampling techniques. A CO sensor can detect the presence of carbon monoxide gas, which, in the home, is typically generated by open flames, space heaters, water heaters, blocked chimneys, and automobiles. The material used in electrochemical CO sensors typically has a 5-7 year lifespan. Thus, after a 5-7 year period has expired, the CO sensor should be replaced. A heat sensor can be a thermistor, which is a type of resistor whose resistance varies based on temperature. Thermistors can include negative temperature coefficient (NTC) type thermistors or positive temperature coefficient (PTC) type thermistors. Furthermore, in this embodiment, detection system 205 can include the following non-safety sensors 222: a humidity sensor, an ambient light sensor, a push-button sensor, a passive infra-red (PIR) sensor, and one or more ultrasonic sensors. A temperature and humidity sensor can provide relatively accurate readings of temperature and relative humidity. An ambient light sensor (ALS) can detect ambient light and the push-button sensor can be a switch, for example, that detects a user's press of the switch. A PIR sensor can be used for various motion detection features. A PIR sensor can measure infrared light radiating from objects in its field of view. Ultrasonic sensors can be used to detect the presence of an object. Such sensors can generate high frequency sound waves and determine which wave(s) are received back by the sensor. Sensors 220 can be mounted to a printed circuit board (e.g., the same board that processors 210 and 230 may be mounted to), a flexible printed circuit board, a housing of system 205, or a combination thereof.

In some embodiments, data acquired from one or more non-safety sensors 222 can be acquired by the same processor used to acquire data from one or more safety sensors 221. For example, safety processor 230 may be operative to monitor both safety and non-safety sensors 221 and 222 for power savings reasons, as discussed above. Although safety processor 230 may not need any of the data acquired from non-safety sensor 222 to perform its hazard monitoring and alerting functions, the non-safety sensor data can be utilized to provide enhanced hazard system 205 functionality. The enhanced functionality can be realized in alarming algorithms according to various embodiments discussed herein. For example, the non-sensor data can be utilized by system processor 210 to implement system state machines that may interface with one or more sensor state machines, all of which are discussed in more detail below in connection with the description accompanying FIG. 3 and in U.S. Patent Publication No. 2015/0022367.

Lighting circuitry 225 may represent any light such as LEDs that may be used to illuminate portions of system 205. Lighting circuitry 225 may selectively illuminate the LEDs to convey information to a user, or can be used to provide a nightlight in some embodiments.

Alarm 234 can be any suitable alarm that alerts users in the vicinity of system 205 of the presence of a hazard condition. Alarm 234 can also be activated during testing scenarios. Alarm 234 can be a piezo-electric buzzer, for example.

Power source 240 can supply power to enable operation of system 205 and can include any suitable source of energy. Embodiments discussed herein can include AC line powered, battery powered, a combination of AC line powered with a battery backup, and externally supplied DC power (e.g., USB supplied power). Embodiments that use AC line power, AC line power with battery backup, or externally supplied DC power may be subject to different power conservation constraints than battery only embodiments. Battery powered embodiments are designed to manage power consumption of its finite energy supply such that hazard detection system 205 operates for a minimum period of time. In some embodiments, the minimum period of time can be one (1) year, three (3) years, or seven (7) years. In other embodiments, the minimum period of time can be at least seven (7) years, eight (8) years, nine (9) years, or ten (10) years. Line powered embodiments are not as constrained because their energy supply is virtually unlimited. Line powered with battery backup embodiments may employ power conservation methods to prolong the life of the backup battery.

In battery only embodiments, power source 240 can include one or more batteries or a battery pack. The batteries can be constructed from different compositions (e.g., alkaline or lithium iron disulfide) and different end-user configurations (e.g., permanent, user replaceable, or non-user replaceable) can be used. In one embodiment, six cells of Li—$FeS_2$ can be arranged in two stacks of three. Such an arrangement can yield about 27000 mWh of total available power for system 205.

Power conversion circuitry 242 includes circuitry that converts power from one level to another. Multiple instances of power conversion circuitry 242 may be used to provide the different power levels needed for the components within system 205. One or more instances of power conversion circuitry 242 can be operative to convert a signal supplied by power source 240 to a different signal. Such instances of power conversion circuitry 242 can exist in the form of buck converters or boost converters. For example, alarm 234 may require a higher operating voltage than high power wireless communications circuitry 212, which may require a higher operating voltage than processor 210, such that all required voltages are different than the voltage supplied by power source 240. Thus, as can be appreciated in this example, at least three different instances of power conversion circuitry 242 are required.

High quality power circuitry 243 is operative to condition a signal supplied from a particular instance of power conversion circuitry 242 (e.g., a buck converter) to another signal. High quality power circuitry 243 may exist in the form of a low-dropout regulator. The low-dropout regulator may be able to provide a higher quality signal than that provided by power conversion circuitry 242. Thus, certain components may be provided with "higher" quality power than other components. For example, certain safety sensors 221 such as smoke detectors and CO sensors may require a relatively stable voltage in order to operate properly.

Power gating circuitry 244 can be used to selectively couple and de-couple components from a power bus. De-coupling a component from a power bus insures that the component does not incur any quiescent current loss, and therefore can extend battery life beyond that which it would be if the component were not so de-coupled from the power bus. Power gating circuitry 244 can be a switch such as, for example, a MOSFET transistor. Even though a component is de-coupled from a power bus and does not incur any current loss, power gating circuitry 244 itself may consume a finite amount of power. This finite power consumption, however, is less than the quiescent power loss of the component.

Self-test module 250 may include one or more programs for testing different hardware components, device functionality, and/or software. Self-test module 250 may store tests specifically designed to detect whether a latent anomaly exists in system 205 or to monitor for the occurrence of the latent anomaly.

It is understood that although hazard detection system 205 is described as having two separate processors, system processor 210 and safety processor 230, which may provide certain advantages as described hereinabove and hereinbelow, including advantages with regard to power consumption as well as with regard to survivability of core safety monitoring and alarming in the event of advanced feature provision issues, it is not outside the scope of the present teachings for one or more of the various embodiments discussed herein to be executed by one processor or by more than two processors.

Figure 3:
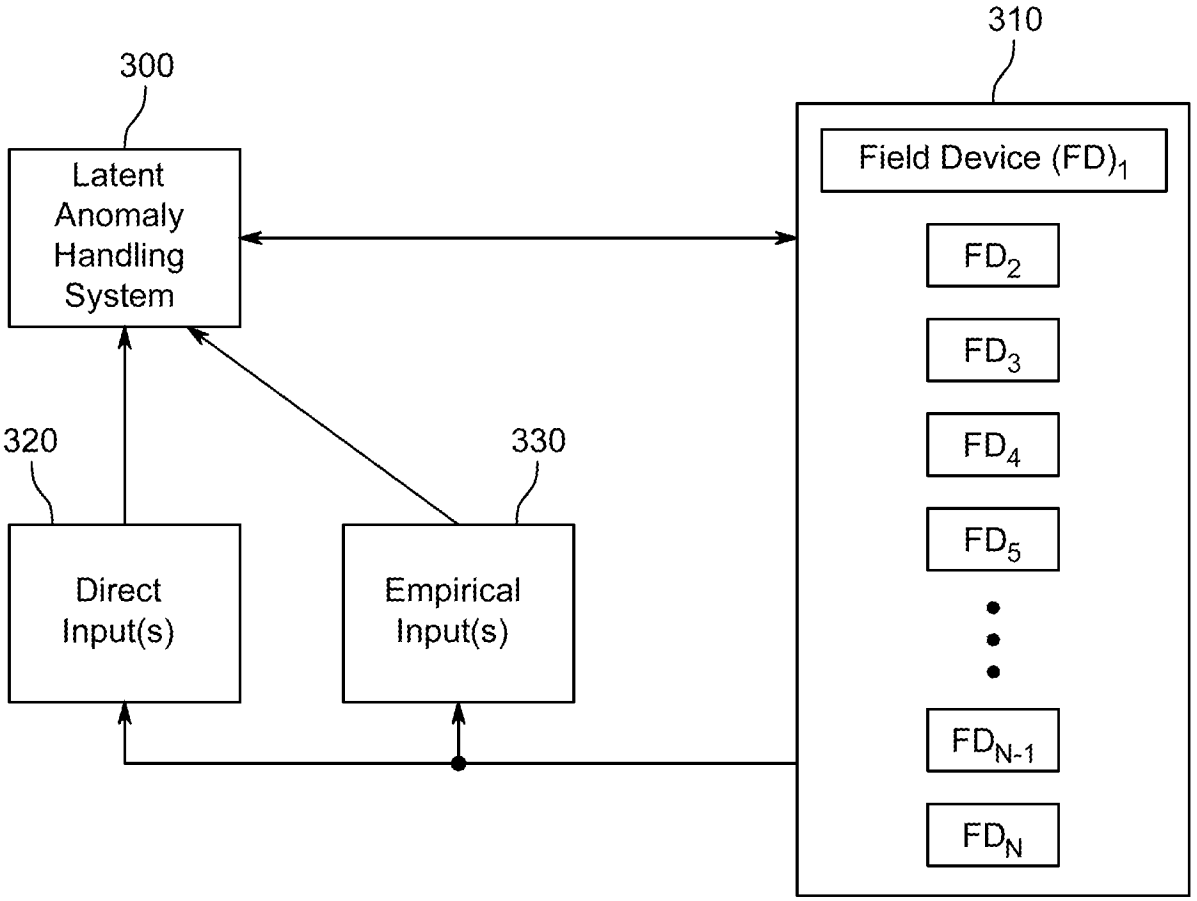
FIG. 3 shows an illustrative block diagram of a latent anomaly handling system, according to some embodiments.

FIG. 3 shows an illustrative block diagram of a latent anomaly handling system 300 according to embodiment. FIG. 3 shows latent anomaly handling system 300 interfacing with field devices 310, and receiving direct inputs 320 and empirical inputs 330. Field devices 310 can represent any number of different devices, however, for ease of presentation, assume that field devices represent different instances of the same class of devices (e.g., hazard detection system 205). Each field device, shown as FD1, FD2, FD3 through FDN, can be represented by different SKUs, generational release (e.g., first generation product, second generation produce), and different versions thereof. Thus, different subsets of field devices may include different internal components than other subsets of field devices. For example, one device may include a first batch run of circuitry produced by a particular silicon chip manufacturer, and another device may include a second batch run of the same circuitry by the same chip manufacturer. As another example, one device may have a wireless circuitry supplied by a first manufacturer and another field device may have its wireless circuitry supplied by a second manufacturer. Thus, while the desired functionality of the field devices may be same, the component composition of the devices may vary. These component composition variances can be one way to group field devices into a subset. As will be discussed in more detail below, if a latent anomaly is identified with a field device having a particular component composition, the subset of field devices associated with that component composition can be targeted to receive specific software to test for or monitor for the known latent anomaly.

Latent anomaly handling system 300 may be responsible for determining whether a latent anomaly exists in a subset of field devices or all field devices, in general, based on data received from field devices 310, direct inputs 320, and empirical inputs 330. In some embodiments, direct inputs 320 and empirical inputs 330 may be derived from data received from field devices 310. Direct inputs 320 may represent latent anomalies that are actually observed in one form or another. For example, a direct input may be derived from a user report indicating that something is not functioning properly in his/her device. As another example, a direct input may be derived from user returns of the field device, where a technician evaluates the returned device to determine the latent anomaly. As yet another example, a direct input can be derived from one or more field based self-tests that are performed by the field unit. For example, in the context of a hazard detection system, self-tests can include a buzzer self-test, a smoke sensor self-test, and speaker self-test. If the field device fails the self-test, it may report the failure as a direct input. In yet another example, a direct input can be derived from devices being tested in a testing system (e.g., a system that is able to subject the device to a battery of tests, tests that can be automatically performed over time to represent the stresses the device may incur over its operational lifetime).

Empirical inputs 330 may represent latent anomalies that are empirically observed in data collected from field devices. The data may be collected from field devices 310 or from devices that are being tested by the testing system. The data may not explicitly show existence of an anomaly (at least something that is glaringly obvious as a potential problem), but analysis of the data indirectly shows that an anomaly is present. For example, historical events such as software crashes, Internet downtimes, lack of smartphone connectivity may be observed, and based on those observations, an inference can be drawn that a device is experiencing some sort of latent anomaly. Empirical inputs 330 may also include analysis of data logs provided by field and tested devices.

Latent anomaly handling system 300 can process inputs 320 and 330 and data from field devices 310 to determine how to handle the anomaly. System 300 can handle anomalies differently depending on the severity of the anomaly, whether the anomaly is detectable using circuitry resident on board the field device, and whether the anomaly is a hardware issue or a software issue. If the severity of the anomaly is considered relatively high, system 300 may inform the owners of the field devices known to potentially exhibit that anomaly to cease using their devices. In some embodiments, with user permission, system 300 may issue a disable device command to the field device, thereby disabling it and preventing its further use. If the severity of the anomaly is relatively low, system 300 may inform the owners that an issue is known to exist with the device and may recommend that certain features not be used. If the anomaly stems from a software issue, system 300 can instruct the field device to perform a software update. If the anomaly stems from a hardware issue, system 300 may determine if the anomaly is detectable. If it detectable, system 300 may instruct the field units to download and install a self-test so that the device can monitor for the occurrence of the anomaly and take appropriate action if the anomaly is monitored.

Figure 4:
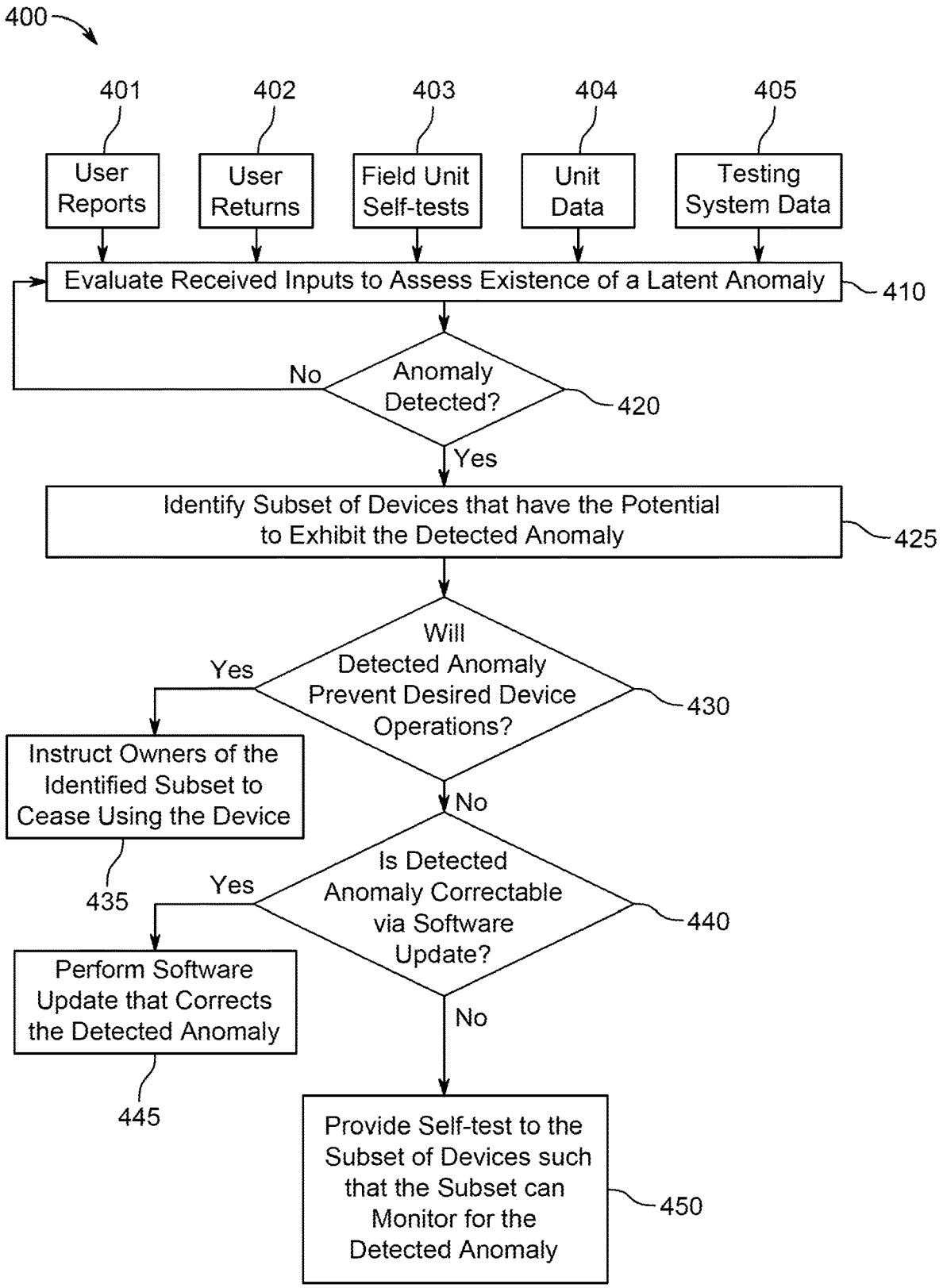
FIG. 4 shows an illustrative process 400 for handling a detected latent anomaly, according to some embodiments.

FIG. 4 shows an illustrative process 400 for handling a detected latent anomaly according to an embodiment. Process 400 may begin at step 410 by evaluating received inputs to assess the existence of a latent anomaly. The inputs can include direct and empirical inputs, as discussed above, or more specifically, can include user reports 401, user returns 402, field unit self-test results 403, unit data 404, and testing system data 405. The evaluation of the inputs can be performed, for example, by latent anomaly handing system 300. At step 420, a determination is made as to whether an anomaly is detected. If the determination is NO, the process 400 reverts back to step 410. If the determination is YES, process 400 may identify a subset of field devices that have the potential to exhibit the detected anomaly, at step 425. The subset of field devices may be identified using any suitable technique, including those that cast relatively wide nets and relatively narrow nets to identify the appropriate field device. For example, a wide net can include all field devices associated with a particular generation of product device. Another net can include all field devices manufacture with a particular time frame. Yet another net can include just those devices that were manufactured with a particular run of components. Yet another net can include just those devices that received a particular software version. Yet another net can include any combination of the above; e.g., a set of devices manufactured with a particular run of components together with a particular software version.

At step 430, a determination is made as to whether the detected anomaly will prevent desired device operations. Desired device operations may include, e.g., the ability of a sensor to perform in accordance within a particular range (e.g., previously specified) of operation, the ability of an actuator to actuate within a particular range (e.g., previously specified) of operation, the ability of a sensor or actuator to perform as previously mentioned within a specified time frame (e.g., whether the detected anomaly will prevent a sensor from performing its desired operations for at least one year, etc.). Desired device operations can also include, for example, uncompromised operation of hardware components such as sensors, integrated circuits, power sources, mechanical components, display components, audio components, or any other suitable component. Some desired device operations may be classified as being relatively important, whereas other device operations may be classified as being relatively less important. For example, a device operation classified as relatively important may include device operations that provide safety features or features deemed critical or necessary for the device to operate in the manner for which it was originally designed. In some embodiments, if the detected anomaly will prevent desired operations, then that device should no longer be used. An anomaly which will prevent desired device operations is contrasted to an anomaly that will not prevent desired device operations. Such an anomaly may affect a device operation classified as being relatively less important. For example, a device operation classified as being relatively less important can include a non-safety feature or non-critical feature that does not affect operation of the relatively important device operations. If the determination at step 430 is that the anomaly is one that will prevent desire operations, process 400 may instruct the owners of the identified subset to cease using the field device (at step 435). Process 400 may also send instructions to the identified subset to indicate that the device should no longer be used. For example, the device may display its light as red to indicate that this is a problem, or it may playback a spoken message indicating that it should no longer be used.

If the determination at step 430 is NO, process 400 may determine whether the anomaly is correctable via a software update (step 440). If YES, a software update may be performed for at least the identified subset to correct the detected anomaly (at step 445). If the determination at step 440 is NO, then it may be inferred that the anomaly is a hardware problem, and a self-test can be provided to the identified subset of field devices (step 450). The identified subset of field devices can then monitor for the detected anomaly, using the self-test, and take appropriate action if and when it is detected. For example, if the anomaly is detected, the field device may notify the owner via a push notification to his smart phone, cause an email to be sent to the owner, display a light or other indicator to signify that there is a potential issue with the device, or playback a spoken message informing the owner of the issue.

It is understood that the steps shown in FIG. 4 are merely illustrative and that additional steps may be added, that some steps may be omitted, and that the order of steps may be rearranged.

In some scenarios, an anomaly may not be actually detected to exist on a known set of devices, but may be suspected to exist. In situations where a suspected (but not confirmed) anomaly exists, a software update may be transmitted to all devices or a subset of those devices. The software update may include a self-test to determine whether the suspected anomaly does exist. Those devices that confirm existence of the suspected anomaly may report the existence to a central server, which may process the report and issue a software update (if the anomaly can be corrected via software) or may issues an instruction to inform the user to cease using the device.

Figure 5:
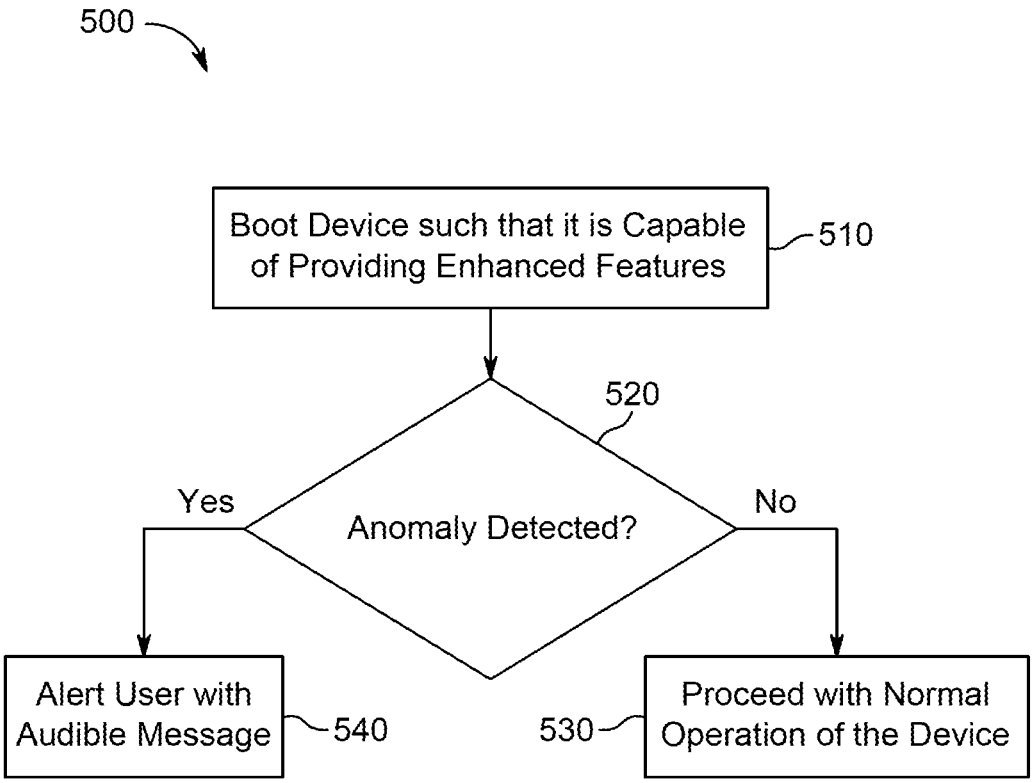
FIG. 5 shows an illustrative process for handling a detected anomaly according to an embodiment.

FIG. 5 shows an illustrative process 500 for managing a detected anomaly according to an embodiment. Process 500 may begin at step 510 by booting a device such that it is capable of providing enhanced features. The device (e.g., system 200) may be capable of handling different operations at varying times. For example, some "essential" features such as hazard detection (i.e., features provided by safety processor 230) may always be active, but "enhanced" features, such as user interaction features (e.g., playback of audio message or other features provided by system processor 210)) may be used on a more limited basis—primarily to conserve power. Thus, any circuitry that is capable of providing the enhanced features may be kept in a relatively low power state until needed. When the enhanced features are needed, then that circuitry is activated. As part of the activation, a processor and/or other circuitry may need to boot up so that it is provided with the appropriate instructions and data to provide the enhanced features. During boot up, the circuitry may access a non-volatile memory (e.g., non-volatile memory 216). Exemplary contents of the non-volatile memory are discussed below in connection with FIGS. 6A and 6B. The processor and/or other circuitry may continue to access the non-volatile memory after boot up, and thus can continuously check the non-volatile memory to determine whether an anomaly has been previously detected and stored in the non-volatile memory.

At step 520, a determination is made as to whether an anomaly has been detected. The anomaly may be a hardware failure, a software failure, or combination thereof that prevents the device from adequately providing one or more basic features or enhanced features. If the anomaly has been previously detected, its existence may be permanently stored in the non-volatile memory. In some embodiments, detected presence of the anomaly may be accessible in the non-volatile memory during boot of the non-volatile memory. In other embodiments, the anomaly detection performed at step 520 may be performed each time the non-volatile memory is accessed. If the determination of step 520 is NO, process 500 may proceed with normal operation of the device, as indicated by step 530. However, if the determination of step 520 is YES, the device may operate in a reduced capacity (e.g., a capacity that is similar to the normal operation, but fewer features are enabled), and alert the user with an audible message, a visual indicator, or both, as indicated by step 540. The alert may be presented immediately, or it may be presented along with other messages as part of a normally scheduled announcement or in response to a user request for the messages. In addition, if an anomaly is detected, feedback can be sent back to a cloud service indicating that an anomaly has been detected, and include device-specific information such as model number, manufacturing date, and information regarding boards, operating system version, embedded software versions in different chips, etc.

It is understood that the steps shown in FIG. 5 are merely illustrative and that additional steps may be added, that some steps may be omitted, and that the order of steps may be rearranged.

Figures 6A, 6B:
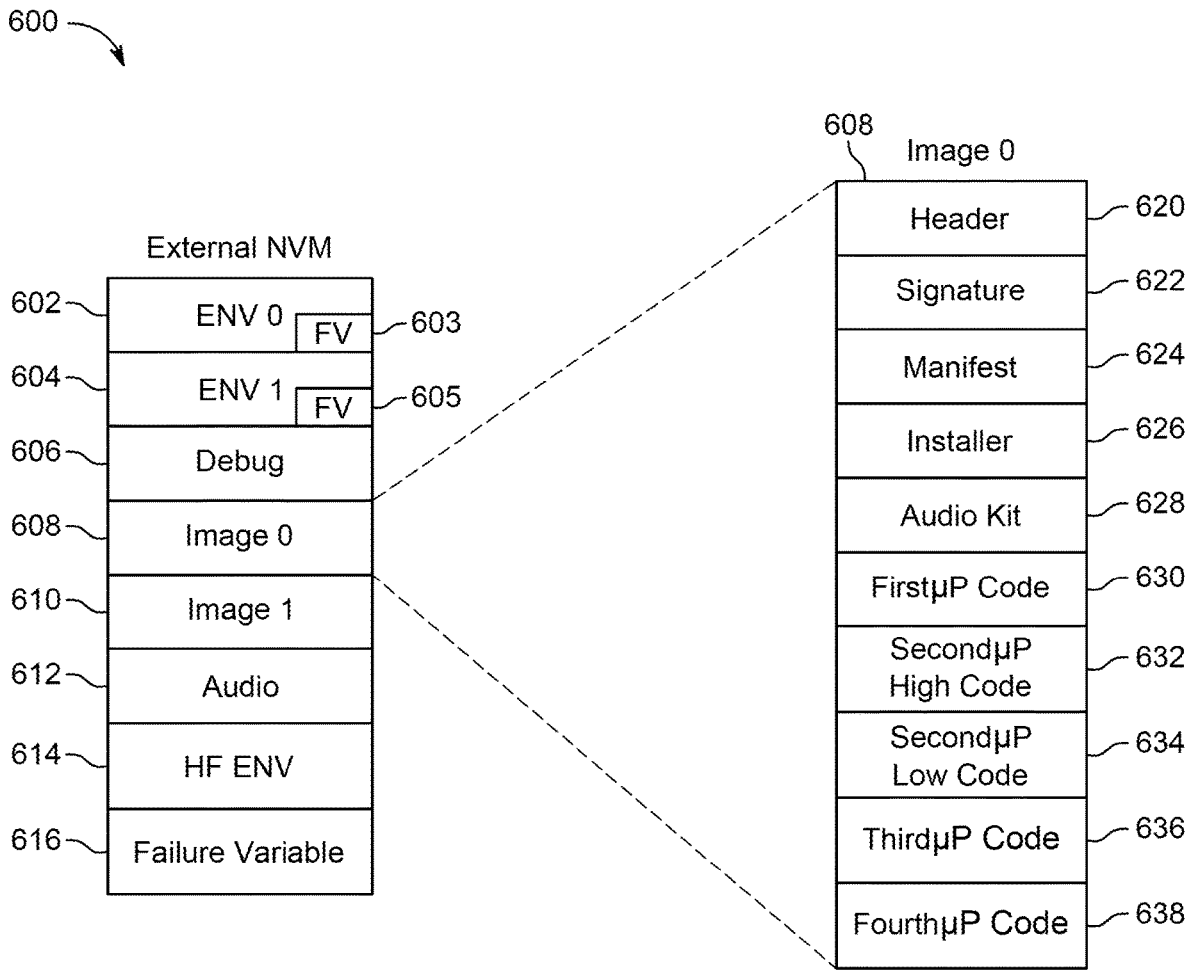
FIG. 6A shows an illustrative schematic of contents contained in non-volatile memory according to an embodiment.
FIG. 6B shows an a more detailed illustrative schematic of a portion of the non-volatile memory of FIG. 6A, according to an embodiment.

FIG. 6A shows an illustrative schematic of contents contained in non-volatile memory (NVM) 600 according to an embodiment. NVM 600 may represent NVM 216 of FIG. 2, for example. NVM 600 may contain several partitions or portions, each operative to store software and other information that may be used by a hazard detection system. As shown, NVM can include ENV 0 portion 602, ENV 1 portion 604, debug portion 606, Image 0 portion 608, Image 1 portion 610, audio portion 612, HF ENV 614, failure variable portion 616. The number of portions shown is merely illustrative and it will be appreciated that additional portions may be included and that one or more portions may be omitted. In addition, the size allocated to each portion may vary. ENV portions 602 and 604 can store environment variables of the device and can each have a failure variable (shown as FV 603 and FV 605) for storing detected failures, including detected anomalies. The contents of ENV portions 602 and 604 can persist after a power loss or a reboot and contain information that is either descriptive of the unique device or descriptive of the device's current state. For example, one or more of ENV portions 602 and 604 may include state machine status of system state machines, user preferences, networking information, and pairing information. During operation, the system may alternate between writing data to portions 602 and 604. For example, the system may first read from portion 602 and find a failure. In finding the failure, the system may then read from portion 604. If a failure is found, the system may then write to the failure variable for portion 604. If one of the parameters of ENV portions 602 or 604 is corrupt or the data is lost, a detected anomaly indication may be stored in that ENV portion's failure variable.

HF Env portion 614 can optionally store high frequency environment variables. For example, portion 614 can store variables that need to be changed relatively frequently, such as for security purposes. Debug portion 606 may include logs for implementing debugging operations. Image 0 and 1 portions 608 and 610 may each include a different version of code for enabling operation of the hazard detection system. Audio portion 612 may store one or more audio files, for example, that may be played back through the speaker (e.g., speaker 218). Failure variable portion 616 may store detected failures, including detected anomalies. Failure variable portion 616 may be separate from the failure variable contained in ENV portions 602 and 604. In some embodiments, failure variable portion 616 may be a redundant version of the failure variable contained in ENV portions 602 and 604.

Image portions 608 and 610 can be either an active or inactive portion, depending on which portion is currently being used for the software executing on the hazard system. For example, if the hazard system is booted using code stored in image portion 608, image portion 608 would be the active portion, and image portion 610 would be the inactive portion. As defined herein, an active portion of code may be code that has been installed in (and being run from) the 'local' memory associated with a processor. As defined herein, an inactive portion of code may be code that exists in a memory (e.g., NVM) but is not currently installed in (and being run from) the 'local' memory associated with a processor. During a software update process (e.g., an over the air download embodiment), a newly downloaded software update package can be stored in the inactive portion. In other embodiments, the downloaded software update package can be stored in any available portion, including the active portion. The software stored in NVM 600 may serve as storage for all of the software running on each of the processors and/or devices contained within the hazard system, but not all the code is executed from the NVM 600. Respective code portions for each processor and/or device can be installed therein and the locally installed code may be executed.

FIG. 6B shows an illustrative schematic of sub-portions of one of the image portions of NVM 600 according to an embodiment. FIG. 6B shows, for example, the sub-portions of image 0 portion 608. It is understood that the arrangement of image 1 portion 610 may be the same as image 0 portion 608, but one or more of the sub-portions may be different. For example, the audio kit portion for image 0 (e.g., audio for English) may be different than the audio kit portion for image 1 (e.g., audio for Spanish). As shown, image 608 can include header portion 620 (e.g., an ELF header), signature portion 622, manifest portion 624, installer portion 626, audio kit portion 628, first μP portion 630, second μP portion 632, second μP portion 634, third μP portion 636, and fourth μP portion 638.

Each portion can include code and/or data necessary to identify information or perform operations associated with its name. For example, header portion 620 can include header information for identifying the location of image 0 in NVM 600. Signature portion 622 may include proprietary information used for authentication. Manifest portion 624 may specify the contents of image 0. For example, manifest portion 624 may specify the software version and its audio kit language. Audio kit portion 628 may contain code and/or files for enabling playback of speech in a specific language. For example, in one embodiment, audio kit portion 628 for image 608 may include speech files in the English language, whereas an audio kit portion for image 610 may include speech files in the French language.

Microprocessor (μP) portions 630, 632, 634, 636, and 638 may each store code or firmware for enabling operation of its (or their) respective microprocessor. The code stored in portions 630, 632, 634, 636, and 638 may be installed in and executed by their respective microprocessors. For example, first (μP) portion 630 may include firmware for enabling a first μP to operate. In some embodiments, the first μP may be similar to system processor 210 of FIG. 2 or processor 402 of FIG. 4. Second P portions 632 and 634 may include firmware for enabling a second μP to operate. In some embodiments, the second μP may be similar to safety processor 230 of FIG. 2 or processor 430 of FIG. 4. Third μP portion 636 may be provided for use with a third processor (e.g., a WiFi processor or high power wireless communications circuitry 212 of FIG. 2). Fourth μP portion 638 may be provided for use with a fourth processor (e.g., a 802.15.4. or low power wireless communications circuitry 214 of FIG. 2).

Figure 7:
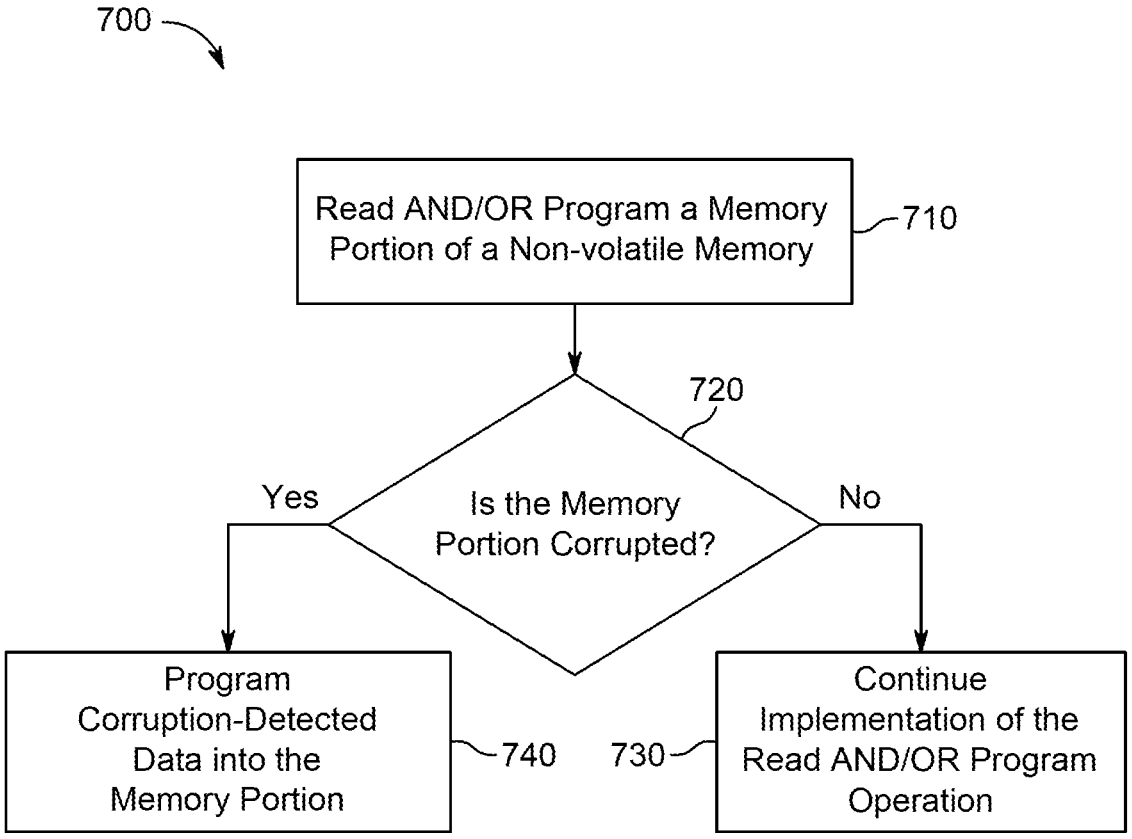
FIG. 7 shows an illustrative process that may be implemented by a hazard detection system when storing existence of a detected anomaly in non-volatile memory according to an embodiment.

FIG. 7 shows an illustrative process 700 that may be implemented by a hazard detection system when storing existence of a detected anomaly in non-volatile memory according to an embodiment. Starting at step 710, the device may read data from or program data to a memory portion of a non-volatile memory. The memory portion may be a portion of memory that is accessed by various device circuitry (e.g., a processor or wireless circuitry) during boot up. At step 720, a determination is made whether the memory portion is corrupted. Corruption may be detected, for example, if the memory portion fails a cyclic redundancy check (CRC check). If the determination is NO, the device may continue implementation of the read and/or program operation, as indicated by step 730. If the determination is YES, the device may program corruption detected data (e.g., anomaly detected data) to the memory portion.

It is understood that the steps shown in FIG. 7 are merely illustrative and that additional steps may be added, that some steps may be omitted, and that the order of steps may be rearranged.

Figure 8:
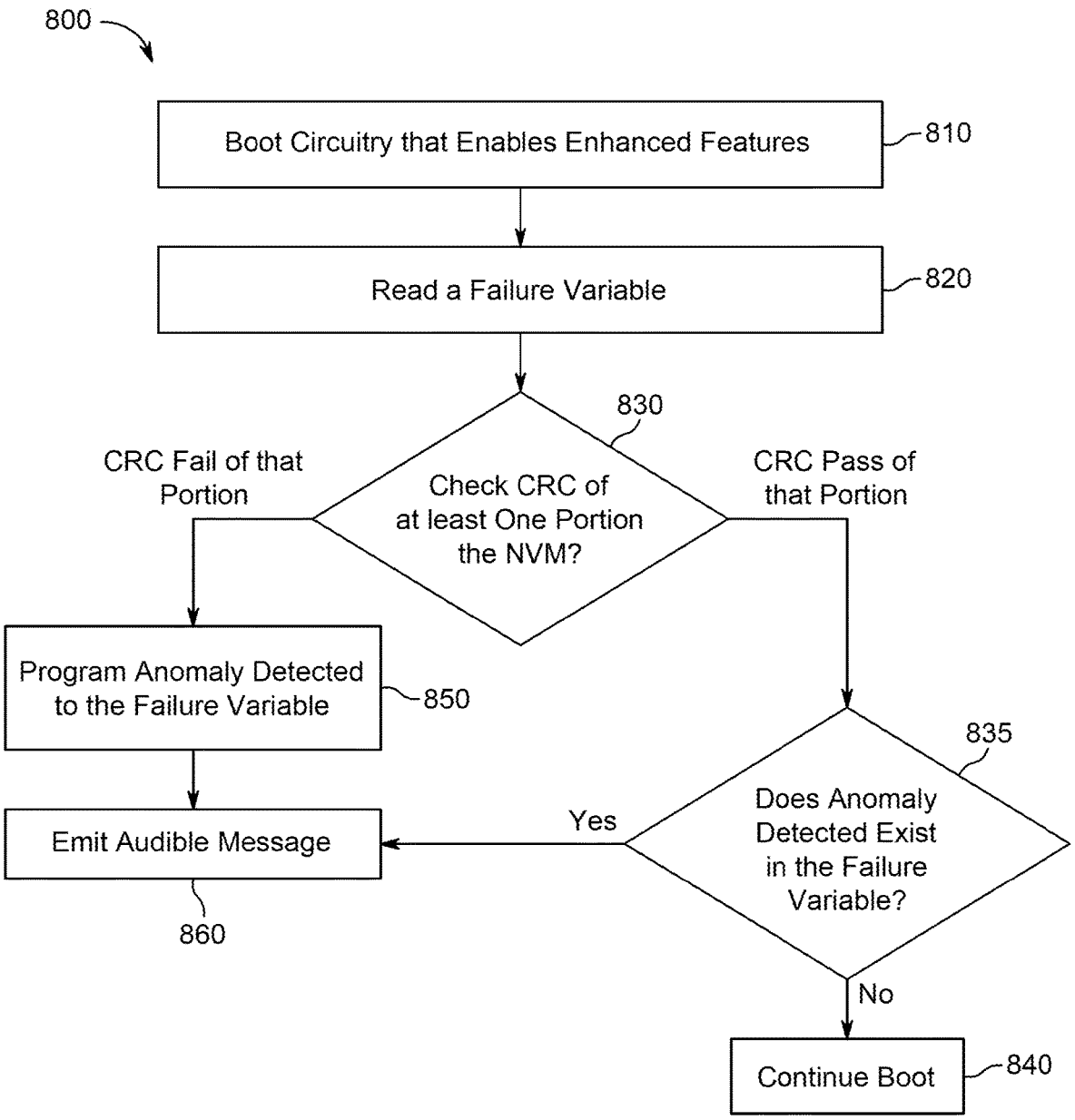
FIG. 8 shows an illustrative process of handling a detected anomaly, according to an embodiment.

FIG. 8 shows an illustrative process 800 of handling a detected anomaly, according to an embodiment. Beginning with step 810, circuitry is booted up that can enable enhanced features. For example, a system process may be booted up to provide enhanced features that cannot be provided by safety processor. At step 820, a failure variable may be read. This failure variable may be contained in one of the ENV portions 602 or 604 of NVM 600, it may be contained in stand-alone failure variable portion 616, as discussed above in connection with FIG. 6A. Any information stored in the failure variable may be later used by the system when reporting one or more failures or warnings (e.g., to the user via audible message, visual messages, or by way of the cloud). At step 830, a CRC is performed on at least one portion of the non-volatile memory. For example, the CRC may be first performed on the newest ENV portion. If the CRC passes on that portion, then the device may verify that the detected anomaly does not exist in the failure variable (at step 835) before allowing the device to continue its boot, as indicated by step 840. If the detected anomaly does exist at step 835, process may proceed to step 860, where an audible message is immediately played back.

If the CRC fails on that portion, anomaly detected data may be programmed into the failure variable, as indicated by step 850. Programming the anomaly detected data into the failure variable ensures that the device is made aware of the existence of the anomaly even if it is not persistent. At step 860, an audible message may be emitted to alert the user of the anomaly. The audible message may be a generic message such as "replace your device" and it may be message that trumps all other potential audible messages that could be reported based on what is stored in the failure variable.

It is understood that the steps shown in FIG. 8 are merely illustrative and that additional steps may be added, that some steps may be omitted, and that the order of steps may be rearranged. For example, if the newest version of the ENV portion fails the CRC check, process 800 can determine whether any one or more backup copies of the ENV portion pass the CRC check. If each of the backup copies fails the CRC check, process 800 may proceed to step 850, as described above. If one of the backup copies passes the CRC check, process 800 may proceed to step 835, as described above.

Figure 9:
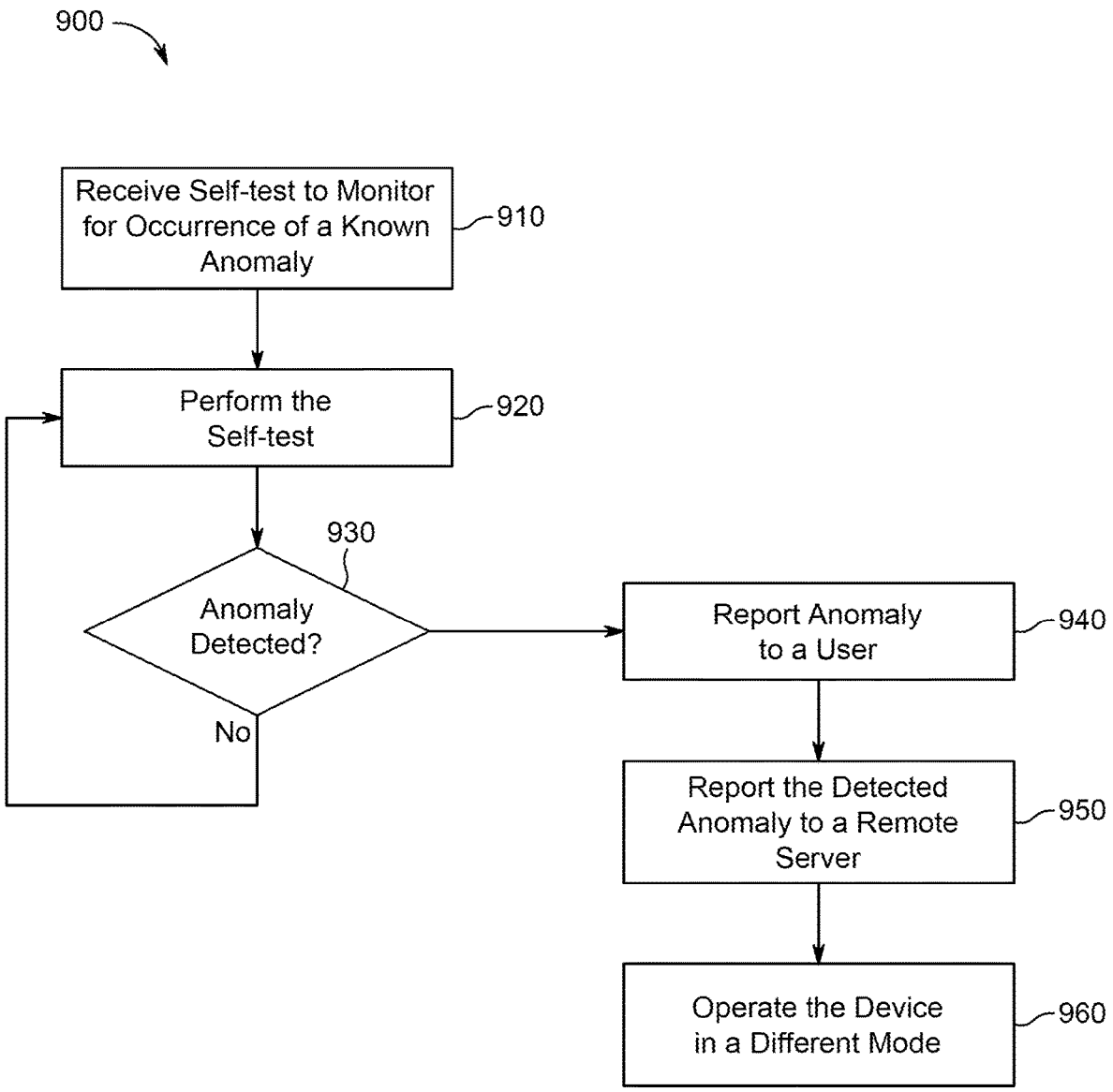
FIG. 9 shows an illustrative process for using a self-test to monitor for a latent anomaly according to an embodiment.

FIG. 9 shows an illustrative process 900 for using a self-test to monitor for a latent anomaly according to an embodiment. At step 910, a field device may receive a self-test to monitor for occurrence of a known latent anomaly. At step 920, the field device may perform the self-test. The self-test may be performed at any suitable time. For example, the self-test may be performed on a periodic basis or on a constant basis. At step 930, a determination is made as to whether the anomaly is detected. If the determination is NO, process 900 may revert back to step 920. If the determination is YES, process 900 may proceed to step 940, where the field device may report the anomaly to a user, and report the detected anomaly to a remote server (step 950). In addition, the field device may begin to operate in a different mode (step 960) in response to monitoring the anomaly. For example, the device may selectively shut down one or more functions affected by the anomaly so that the device can continue to operate, but to a lesser extent for which it was designed. As another example, the device may cease all functionality, thereby bricking itself.

It is understood that the steps shown in FIG. 9 are merely illustrative and that additional steps may be added, that some steps may be omitted, and that the order of steps may be rearranged.

In some embodiments, it may be desirable to proactively subject field units to a battery of tests to simulate stresses the field unit could potentially incur over its operational life, thereby proactively discovering any possible latent defects. The tests may be designed to test and stress many operational features, circuitry, and components of the field device, and a testing system is able to monitor and record the results of each test. The testing system can also test user scenarios. Some of the operational features may include visual features such as, for example, specific display of lights of LEDs, content displayed on a display screen, and/or other user interface elements. Other operational features can include audio features such as, for example, voice message playback, buzzer alarm, and/or audio beeps or clicks made in response to user input. Yet additional operational features can include wireless communications between field devices, a field device and a router, a field device and a smart phone, and/or a field device and another smart device such as a smart light.

The test system may be designed to automatically test products in various user scenarios. For example, when setting up a device, there are many user interactions that need to be tested such as visually detecting the color of lights and other UI elements. Another example is when a product speaks, it may be desirable to ensure that playback of audio files is sufficiently clear and devoid of pops, clicks, or garbling that may occur when a product is under stress. The test system can automate the detection of these features so that a trained human does not have to physically observe the device in test.

The test system apparatus can include a testing platform that takes the shape of a fully enclosed box, in which the device being tested resides. The test system can include an array of test sensors such as, for example, a camera, a video camera, a webcam, a microphone, a vibration sensor, and any other suitable sensor. The test system can also include lighting, device and sensor mounting hardware, green screen fabric, sound insulation, power, and connections. The test system may also include control circuitry for controlling the sensors and the device, and may include a data logger for storing the results of the tests.

As mentioned above, the test system may be able to monitor visual outputs of the device. This can be accomplished using computer vision techniques that use an initial setup phase for identifying (and defining) particular areas of interests (AOIs) on the device to be monitored and a test phase for continuously monitoring those AOIs during the battery of tests. The setup phase is now discussed in conjunction with FIG. 10.

Figure 10:
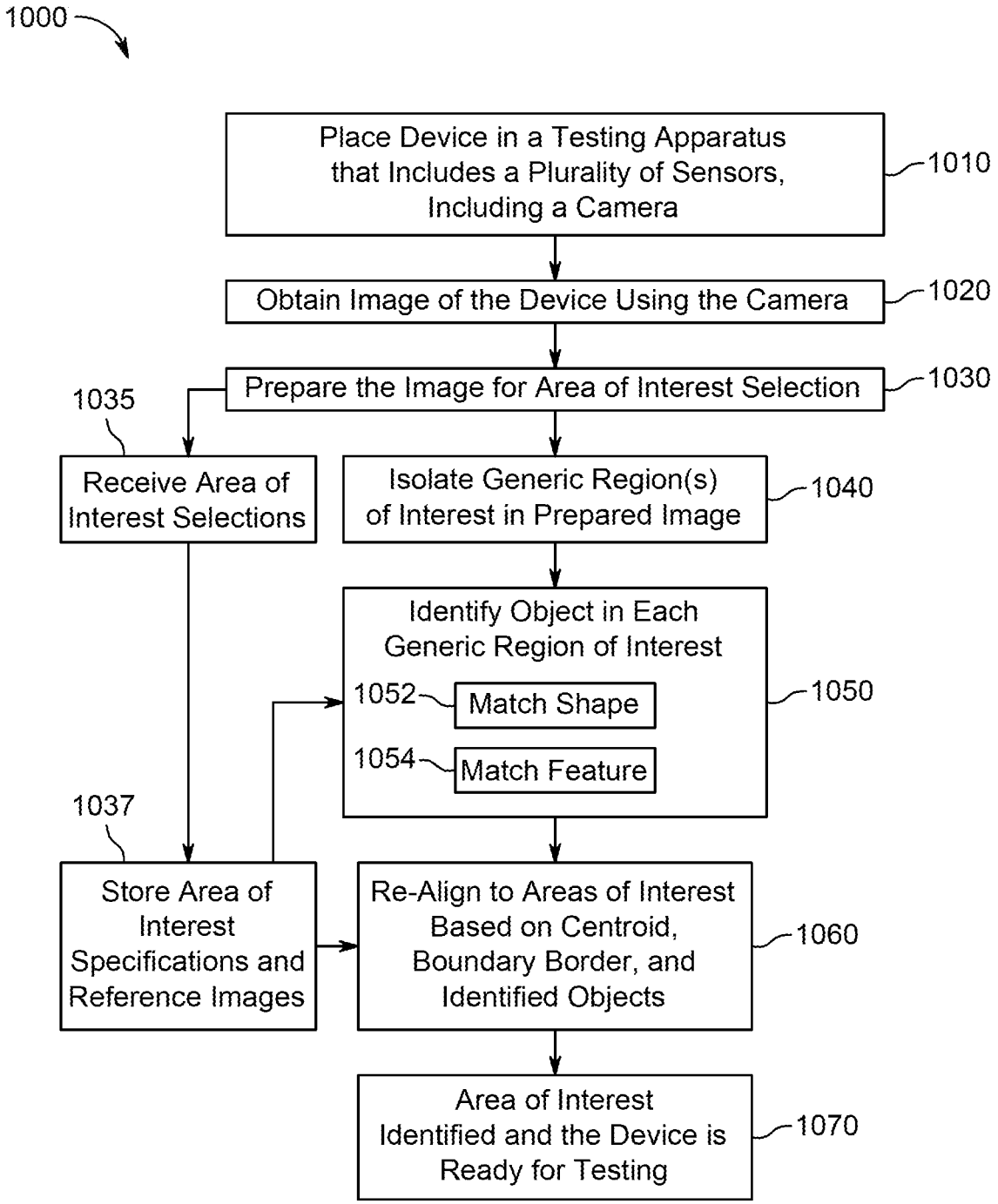
FIG. 10 shows illustrative process for establishing the visual monitoring setup phase of a test system according to an embodiment.

FIG. 10 shows illustrative process 1000 for establishing the visual monitoring setup phase of a test system according to an embodiment. Starting with step 1010, a device is placed into a testing apparatus that includes several sensors, including a camera, and other electronics. At step 1020, an image of the device is obtained using the camera. The image may be a still picture even though it was obtained using a camera with video capture capability. At step 1030, the image may be prepared for area of interest isolation and/or selection. For example, any background (e.g., the green screen) in the image may be removed using the chroma key compositing and morphological opening to provide a cleaned image. If no areas of interests have been previously configured or there are no reference images yet available, process 1000 may proceed to step 1035.

At step 1035, area of interest selections may be received in response to user selections. For example, the user may be presented with the cleaned image of the device under test and provided with graphical user interface (GUI) selection tools that allow the user to define the areas of interest that he or she wants the test system to monitor. Using the GUI selection tools, the user may draw polygons, circles, or other geometric shapes around particular objects on the device. For example, if the user would like to monitor a light ring, he can draw a circle around the light ring. As another example, if the user would like to monitor a LCD screen, he can draw a rectangular shape around the display. If desired, the user can also mask areas that are not to be observed. For example, referring back to the light ring, the user may not want to monitor the space inside the ring and may mask that interior space.

At step 1037, the system may approximate a boundary border and a centroid for the device. The centroid and boundary may be determined by the shape of the device and areas removed from chroma keying and morphological opening. A frame of reference can be obtained based on a combination of the centroid and the boundary. The centroid may then be used as a reference point for storing the location of each area of interest selection (e.g., the GUI selected polygons and circles). After all GUI selections of AOIs are selected and stored as AOI specifications, one or more reference images may be stored. Objects specified in the AOI specifications can be identified based its similarity to the reference image. Thus, the reference image may provide a basis for enabling step 1050 to identify objects in the image.

Returning to step 1030, and assuming that the AOIs and reference images are stored, process 1000 may proceed to step 1040. At step 1040, generic region(s) of interest may be isolated in the cleaned image. For example, the generic region can be the device itself. As another example, an image processing controller may identify one or more generic regions that exist on the device. These generic regions may serve as starting points for enabling the image processing controller to more particularly identify objects in the cleaned image. In addition, at step 1040, the centroid and boundary may be determined by the shape of the device (in the prepared image) and areas removed from chroma keying and morphological opening.

At step 1050 the objects are identified using a detection process that uses shape matching 1052 and feature matching 1054 to compare the cleaned image to the reference image (s). Each comparison generates a similarity score and the combination of scores is used to identify the object. Shape matching 1052 may be performed by applying a combination of Gaussian and Laplacian functions to reduce an image to its edges and then computing the Hu's image moments. Feature matching 1054 may be a brute-force matching method performed after extracting features using Accelerated-KAZE, outlying matches are then removed using Random Sample Consensus (RANSAC).

After the objects are identified, the areas of interest are re-aligned based on the centroid, boundary border, and the identified objects (at step 1060). After the re-alignment of the area of interest is complete, the area of interests are identified and the device is ready for the test phase (step 1070).

It is understood that the steps shown in FIG. 10 are merely illustrative and that additional steps may be added, that some steps may be omitted, and that the order of steps may be rearranged.

Figure 11:
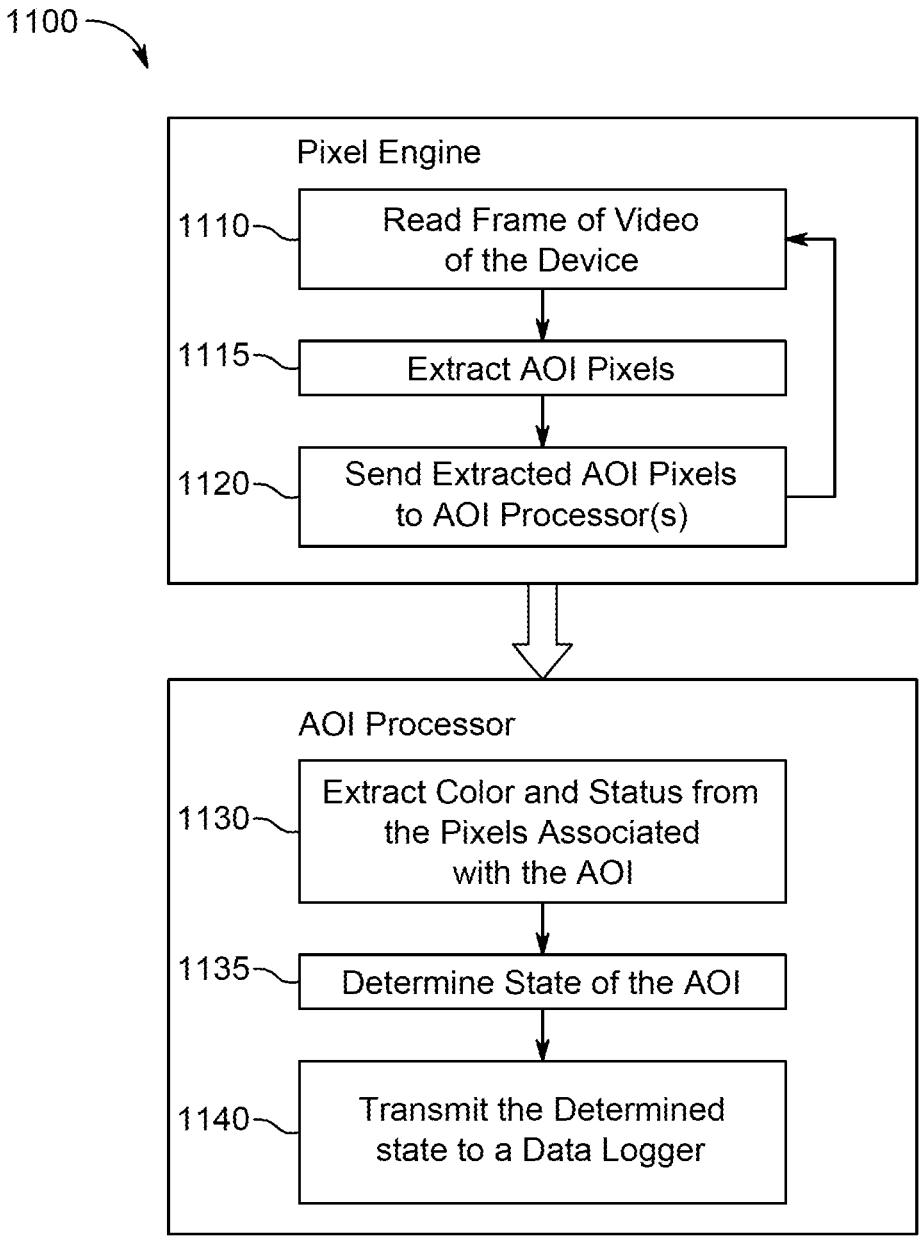
FIG. 11 shows illustrative process for processing images in each area of interest according to an embodiment.

FIG. 11 shows illustrative process 1100 for processing images in each area of interest according to an embodiment. After the set-up phase is complete and the areas of interest are identified for the device placed in the testing apparatus, image processing of the areas of interest can commence. In one embodiment, the image processing can detect changes (e.g., color change) in each area of interest. Starting with step 1110, a pixel engine may read a frame of video of a device being tested in the testing apparatus. At step 1115, pixels in each area of interest are extracted from the frame. The extracted pixels are transmitted to an area of interest processor (step 1120), and the next scene is processed by returning to step 1110. Each area of interest may be assigned its own processor. Thus, if there are two areas of interest in the scene, the pixels associated with the first AOI is sent to a first processor and the pixels associated with second AOI is sent to a second processor. Thus, although only one AOI processor shown in FIG. 11, the AOI is meant to be representative of all necessary AOI processors.

At step 1130, the AOI processor can extract color and status from the pixels associated with the AOI. For example, the pixels can be converted to a Hue-Saturation-Value format to determine the color and status (ON or OFF) of each pixel of the AOI. A state of the AOI is determined based on an average of the Hue-Saturation-Values and status of all pixels associated with that AOI (step 1135). For example, if the AOI is a light ring, the state may indicate the color being emitted by the light ring. The determined state of the AOI may be transmitted to a data logger (step 1140). The data logger may be able track changes in state as the color in the AOI changes over time.

It is understood that the steps shown in FIG. 11 are merely illustrative and that additional steps may be added, that some steps may be omitted, and that the order of steps may be rearranged.

The test system can also test audible outputs, including spoken words. In one embodiment, cloud speech API (e.g., Google's Cloud Speech API) can be used to provide recognition of the spoken words detected within the test fixture. Utterances can be detected based on the Root-Mean-Squared power of the audio signal, and a specified quiet interval. Utterances can then be transcribed using the cloud speech API and can be verified against reference speech specifications. The results can be sent to a data logger that can keep track of instances in which the utterances do not match the reference speech.

The test system can test any number of suitable factors, including HVAC operations of a thermostat, and integration with third party devices. Moreover, the flexibility of the test system enables proactive detection of latent anomalies, the detection of which is discussed below in connection with FIG. 12.

Figure 12:
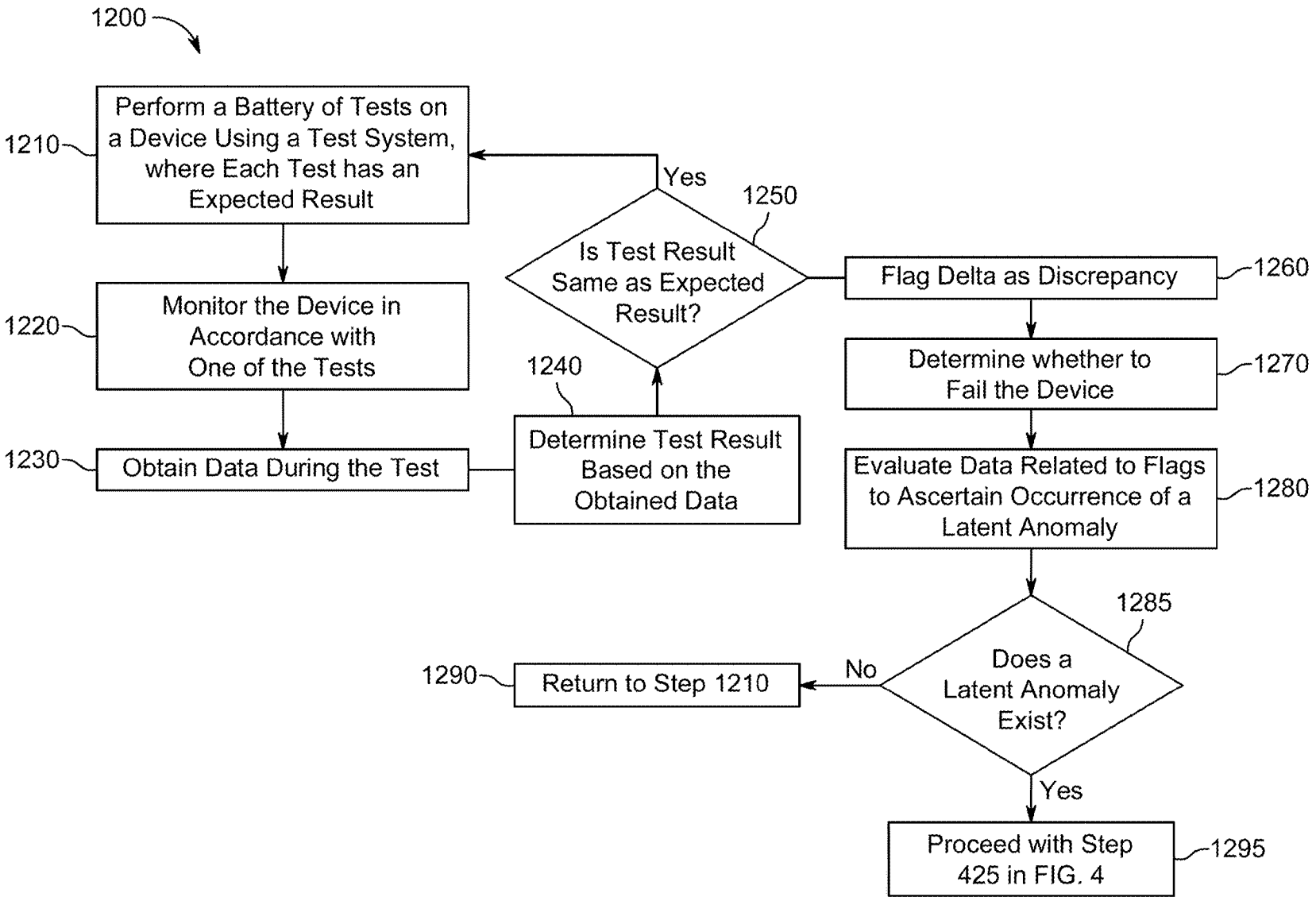
FIG. 12 shows illustrative process for proactively searching for latent anomalies using a test system in accordance with an embodiment.

FIG. 12 shows illustrative process 1200 for proactively searching for latent anomalies using a test system in accordance with an embodiment. Process 1200 may use a test system such as the test system discussed above in connection with FIGS. 10 and 11. Process 1200 may begin by performing a battery of tests on a device using a test system, where each test has an expected result (at step 1210). The battery of tests may include a large variety of tests to stress all parts of the device and the tests may be repeated over and over again to simulate the operational life of the device or a safety factor of 2 to 3 times the operational life of the device. At step 1220, the device may be monitored in accordance with one of the test in the battery of test and at step 1230, data is obtained during that test. At step 1240, a test result is determined based on the obtained data.

At step 1250, a determination is made whether the test results is the same as the expected result. If the determination is YES, process 1200 can loop back to step 1210. If the determination is NO, process 1200 may flag the delta in results as a discrepancy at step 1260. At step 1270, a determination is made whether to fail the device. The failure determination may be a qualitative assessment and not a binary one. For example, it may be that the device fails the test once every ten test, but passes the other nine tests. The data related to the flag may be evaluated to ascertain potential occurrence of a latent anomaly in the device (as indicated by step 1280).

At step 1285, a determination is made as to whether a latent anomaly exists. If NO, process 1200 may return to step 1210. If the determination is YES, in accordance with step 1295 process 1200 may proceed with step 425 in FIG. 4.

It is understood that the steps shown in FIG. 12 are merely illustrative and that additional steps may be added, that some steps may be omitted, and that the order of steps may be rearranged.

It is understood that although the software update techniques are described herein with respect to a hazard detection system, these techniques may also be used in any system or device where it is desired to maintain sensing and monitoring of other events while updating the operational capabilities of one of more components of that system or device. For example, the other events can include events that are not necessarily tied to hazards such as smoke, CO, and heat, but can include motion detection, sound detection, and the like. Events reported by remote devices may also be taken into account. For example, security device such as window and door sensor, and motion detection sensors that provide feedback to a system may quality as other events.

Any processes described with respect to FIGS. 1-12, as well as any other aspects of the invention, may each be implemented by software, but may also be implemented in hardware, firmware, or any combination of software, hardware, and firmware. They each may also be embodied as machine- or computer-readable code recorded on a machine- or computer-readable medium. The computer-readable medium may be any data storage device that can store data or instructions which can thereafter be read by a computer system. Examples of the computer-readable medium may include, but are not limited to, read-only memory, random-access memory, flash memory, CD-ROMs, DVDs, magnetic tape, and optical data storage devices. The computer-readable medium can also be distributed over network-coupled computer systems so that the computer readable code is stored and executed in a distributed fashion. For example, the computer-readable medium may be communicated from one electronic subsystem or device to another electronic subsystem or device using any suitable communications protocol. The computer-readable medium may embody computer-readable code, instructions, data structures, program modules, or other data in a modulated data signal, such as a carrier wave or other transport mechanism, and may include any information delivery media. A modulated data signal may be a signal that has one or more of its characteristics set or changed in such a manner as to encode information in the signal.

It is to be understood that any or each module or state machine discussed herein may be provided as a software construct, firmware construct, one or more hardware components, or a combination thereof. For example, any one or more of the state machines or modules may be described in the general context of computer-executable instructions, such as program modules, that may be executed by one or more computers or other devices. Generally, a program module may include one or more routines, programs, objects, components, and/or data structures that may perform one or more particular tasks or that may implement one or more particular abstract data types. It is also to be understood that the number, configuration, functionality, and interconnection of the modules or state machines are merely illustrative, and that the number, configuration, functionality, and interconnection of existing modules may be modified or omitted, additional modules may be added, and the interconnection of certain modules may be altered.

Whereas many alterations and modifications of the present invention will no doubt become apparent to a person of ordinary skill in the art after having read the foregoing description, it is to be understood that the particular embodiments shown and described by way of illustration are in no way intended to be considered limiting. Therefore, reference to the details of the preferred embodiments is not intended to limit their scope.

What is claimed is:

1. A method for determining existence of a latent anomaly, comprising:

performing a plurality of tests on a device using a test system, wherein each of the plurality of test has an expected result;

monitoring the device in accordance with a first one of the plurality of tests;

obtaining data during the first one of the plurality of tests; and in response to determining a test result based on the obtained data is different than the expected result:

analyzing the data obtained during the first one of the plurality of tests to ascertain potential occurrence of a latent anomaly in the device.

2. The method of claim 1, in response to detecting existence of the latent anomaly:

identifying a subset of a plurality of field devices that has potential to exhibit the latent anomaly; and provide a self-test to each field device in the identified subset such that each field device in the identified subset can monitor for the latent anomaly and perform an action in response to monitoring for the occurrence of the latent anomaly.

3. The method of claim 1, wherein the plurality of tests subject the device to stresses that field devices could potentially incur over their operational lives.

4. The method of claim 1, wherein the obtaining data during the first one of the plurality of tests comprises:

obtaining an image of the device;

preparing the image for area of interest selection;

isolating at least one generic region of interest in the prepared image;

identifying an object in each of the at least one generic region of interest;

re-aligning the area of interest selection with the identified object; and testing the device in accordance with the first one of the plurality of tests by observing the re-aligned area of interest selection.

5. The method of claim 4, wherein the identifying comprises using shape matching to identify the object.

6. The method of claim 5, wherein the using shape matching comprises:

applying a combination of Gaussian and Laplacian functions to produce an edge centric image; and computing Hu's image moments on the edge centric image.

7. The method of claim 4, wherein the identifying comprises using feature matching to identify the object.

8. The method of claim 7, wherein the using feature matching comprises extracting features from the image using an accelerated-KAZE technique to identify the object.

9. The method of claim 1, wherein the obtaining data during the first one of the plurality of tests comprises:

obtain a frame of video of the device;

extract pixels from at least one area of interest within the frame;

determine a state of the at least one area of interest based on the extracted pixels, wherein the state is used to determine the test result.

10. A method for handling latent anomalies, comprising:

evaluating a plurality of data sources to detect existence of a latent anomaly; and in response to detecting existence of the latent anomaly:

in response to confirming that the latent anomaly does not prevent desired operation of a field device and cannot be corrected via an software update, providing a self-test to the field device such that the field device can monitor for the latent anomaly and perform an action in response to monitoring the occurrence of the latent anomaly.

11. The method of claim 10, wherein in response to confirming that the latent anomaly is fatal to operation of the field device, providing a notice to a user of the field device that the latent anomaly fatal to field device operation.

12. The method of claim 10, wherein in response to detecting existence of the latent anomaly can be corrected by a software update, instructing the field device to perform a software update.

13. The method of claim 10, wherein the plurality of data sources comprises direct inputs that identify latent anomalies that are actually observed.

14. The method of claim 10, wherein the plurality of data sources comprises empirical inputs that identify latent anomalies that are empirically observed in data collected from field devices.

15. The method of claim 10, wherein the plurality of data sources comprises a testing system capable of running a battery of tests that subject the field device to stresses that the field device could potentially incur over its operational life.

16. The method of claim 15, wherein one of the test performed by the testing system comprises a visual observation test that monitors at least one area of interest on a test device.

17. The method of claim 15, wherein one of the tests performed by the testing system comprises an audio observation test that verifies accuracy of speech emitted by the test device.

18. The method of claim 10, wherein the latent anomaly is a defect that is discovered to exist within a field device after that field device has been sold.

* * * * *